US008507783B1

(12) United States Patent
Barbera

(10) Patent No.: US 8,507,783 B1
(45) **Date of Patent: *Aug. 13, 2013**

(54) TRANSDUCER SADDLE FOR STRINGED INSTRUMENT

(76) Inventor: Richard Barbera, Staten Island, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/233,319

(22) Filed: Sep. 15, 2011

Related U.S. Application Data

(63) Continuation-in-part of application No. 12/855,418, filed on Aug. 12, 2010, now Pat. No. 8,263,851, which is a continuation-in-part of application No. 12/266,962, filed on Nov. 7, 2008, now Pat. No. 8,049,095.

(51) Int. Cl.
*G10H 1/32* (2006.01)

(52) U.S. Cl.
USPC ..... 84/743

(58) Field of Classification Search
USPC ..... 84/743, 731
See application file for complete search history.

(56) References Cited

U.S. PATENT DOCUMENTS

| | | | | |
|---|---|---|---|---|
| 4,860,625 | A * | 8/1989 | Mathews | 84/731 |
| 4,867,027 | A * | 9/1989 | Barbera | 84/731 |
| 5,078,041 | A * | 1/1992 | Schmued | 84/731 |
| 5,218,159 | A * | 6/1993 | McClish | 84/731 |
| 5,410,101 | A * | 4/1995 | Sakurai | 84/731 |
| 5,817,966 | A * | 10/1998 | Fishman | 84/731 |
| 6,822,156 | B1 * | 11/2004 | Lazarus et al. | 84/731 |
| 7,394,015 | B2 * | 7/2008 | Takabayashi | 84/731 |
| 2002/0157523 | A1 * | 10/2002 | Takabayashi | 84/731 |
| 2004/0105560 | A1 * | 6/2004 | Naniki | 381/190 |
| 2004/0134330 | A1 * | 7/2004 | Braun et al. | 84/298 |
| 2009/0038461 | A1 * | 2/2009 | Dunwoodie | 84/298 |

* cited by examiner

*Primary Examiner* — Jianchun Qin
(74) *Attorney, Agent, or Firm* — Scully, Scott, Murphy & Presser, P.C.

(57) ABSTRACT

A string saddle system for a multi-stringed instrument includes a unitary saddle body having a plurality of integral cavities, each in correspondence with a respective string and defining an area of sensitivity beneath each string extending from a top saddle body surface to the corresponding cavity structure and extending horizontally according to a length of the integral cavity. A flexurally responsive transducer element is located within and mechanically coupled to each integral cavity at mechanical coupling points for converting vibratory energy from the respective string to an electric signal. A first conductor layer is embedded within the saddle body, and, a second conductor layer embedded within the saddle body, the first and second conductor layers configured on a unitary plane, and connected to each transducer such that the transducer element of adjacent integral cavities couple electrical signals of alternating phase.

20 Claims, 27 Drawing Sheets

TRANSDUCER SADDLE FOR STRINGED INSTRUMENT

CROSS-REFERENCE TO RELATED APPLICATIONS

This application is a continuation-in-part application of U.S. patent application Ser. No. 12/855,418 filed Aug. 12, 2010 now U.S. Pat. No. 8,263,851 which is a continuation-in-part application of U.S. patent application Ser. No. 12/266,962 filed Nov. 7, 2008 now U.S. Pat. No. 8,049,095 entitled TRANSDUCER SADDLE FOR STRINGED INSTRUMENT and each of which are incorporated by reference as if fully set forth herein.

BACKGROUND

1. Field of Invention

The present invention relates generally to stringed musical instruments. Specifically, the present invention relates to providing a transducer saddle system for a stringed instrument.

2. Description of Related Art

Acoustic stringed instruments typically comprise a hollow body portion coupled to a neck portion extending longitudinally from a side wall of the hollow body portion. Steel, nylon, or other materials are used to make strings that are stretched from the distal end of the neck portion to a point on the top surface of the body portion. At each end, the strings rest on raised bars made of a hard material such as hard plastic or ivory. In guitars, this raised bar is typically called a nut at the neck, and a saddle at the bridge. Each string on a stringed instrument, such as a guitar, is set to a fixed length and tension, the length being fixed between the nut and the bridge. The bridge is a device on the top surface of the body that receives the string and maintains the tension of the string. The bridge further interfaces the strings with body and transfers string vibrations to the guitar top, maintains proper height clearance of strings over the fretted neck, establishes scale length of vibrating string.

Acoustic stringed instruments can be amplified in several ways. A microphone may be placed in front of a sound hole formed on the top surface of the instrument. When plucked, the string vibrates in virtually all axes of direction in the plane perpendicular to the direction of the string. These vibrations are transmitted to the body via the bridge, resonate within the hollow body, and are emitted via the sound hole. The problem with using microphones is that the microphone picks up not only the sound of the vibrating string, but every other sound caused by playing the instrument, such as string noise, bumps and taps, as well as ambient noise from other instruments etc. The microphone can further cause feedback by picking up noise from the instruments' vibrating top, which is further amplified by the surrounding speakers/amplifiers.

Also a microphone has a very limited volume range and is ineffective when competing with other amplified instruments.

Another technique involves the use of guitar pickups, in the form of electromagnetic coils, or and piezo-electric transducers. Typically, mechanically coupled acoustic guitar pickup designs employ various types of compressively sensitive transducer materials which are sandwiched between the guitar saddle and the surface of the instrument's bridge or bridge plate. Compressively mounted transducers beneath the saddle tend to have a characteristic pinched and compressed quality of sound. This approach yields little directional biasing or selectivity in the vibratory information that is picked up and amplified. Consequently on an acoustic instrument much micro-phonic noise is collected and amplified along with the desired "musical information". Micro-phonic noise occurs when a pickup systems axis of sensitivity is mechanically coupled to the instruments resonant top. This coupling sensitizes the entire resonant surface of the instrument through the transducer system, causing every bump or knock on the instrument to be amplified. Micro-phonic sensitivity also increases feedback sensitivity because certain resonant frequency sensitivities in the instrument top become magnified, causing an uncontrollable feedback loop when the amplified signal excites the instruments top and strings through sympathetic resonances. Micro-phonic sensitivity also tends to yield an amplified sound which is "unfocused and boomy," this occurs when sensitive resonant frequencies in an instrument overpower the rest of the spectrum.

What is needed is an amplification apparatus for a multi-stringed musical instrument that provides uni-directional sensitivity to vertical string vibrations. Additionally, what is needed is a pickup apparatus for a multi-stringed musical instrument which does not microphonocally sensitize the instruments resonant top so as to eliminate micro-phonic noise from the body of the instrument while remaining mechanically responsive to vertical string motion. Also, what is needed is a pickup apparatus for a multi-stringed musical instrument that senses each strings vibrational outputs individually with a high degree of isolation from adjacent strings. This to enable the balancing of the individual strings outputs relative to each other, and to perform this passively through the electro-mechanical calibration of the pickup structure, without relying on a multi channel, active circuit to balance the string output signals.

SUMMARY OF THE INVENTION

There is provided a highly efficient means of coupling to sensors, vibrations from plucked musical instruments strings. In one aspect, the present invention is a transducer saddle system that mechanically conveys vertical aspects of string vibrations to transducers by way of cavities within a saddle body beneath a string saddle crown that establish vertically compliant areas within the saddle. The vertically compliant areas beneath each string are mechanically responsive to vertical string motion. Alternately, in some unitary saddle designs, the compliant areas within the saddle are additionally sensitive to horizontal string vibrations. These areas couple the strings to transducers mounted within said cavities, and are selectively sensitive to vertical string vibrations from the top of the saddle, beneath the string. This sensitivity does not respond to vibratory information from beneath the saddle and is sensitive from its top or positive Z axis direction primarily. This eliminates the introduction of micro-phonic noise from the body of the instrument in the amplified signal. Isolating the vertical component of the string vibration further maximizes fidelity, clarity of sound and responsiveness.

Further to this aspect, the adjacent cavities housing the transducers and respective conductive circuitry are arranged in alternating phase circuit relationships to avoid phase cancellation effects between the adjacent transducers. Alternately, the adjacent cavities housing the transducers and respective conductive circuitry are arranged in non-alternating phase circuit relationships (i.e., "uniphase").

Accordingly, there is provided a string saddle system for a multi-stringed instrument comprising: a saddle body having a top surface and opposing side surfaces, said saddle top surface spanning all tensioned strings of said multi-stringed instrument to support the tensioned strings and to receive vibratory energy therefrom, said saddle body having a plurality of integral cavities, each integral cavity in correspondence with a respective string and defining a compliant area of sensitivity beneath each string within the saddle body, each compliant area of sensitivity extending from said top surface of said saddle body above the cavity beneath said respective string to said corresponding cavity structure and extending horizontally according to a length of said integral cavity; a flexurally responsive transducer element mechanically coupled to each integral cavity at mechanical coupling points, said transducer element for converting vibratory energy from the respective string to an electric signal, said compliant area conveying vibrations of the respective string to said suspended transducer element via a mechanical coupling point located within each respective integral cavity structure; a first conductor embedded within said saddle body; and, a second conductor embedded within said saddle body, said first and second conductors configured on a unitary plane, wherein said embedded first and said embedded second conductor have respective portions extending to each said integral cavity structure to provide exposed electrical contact areas at a cavity surface defining electrical coupling points for electrically connecting the transducer element to said first and second embedded conductors at each respective said integral cavity structure, the electrical coupling points electrically connect the transducer element to said first and second conductors at each respective said integral cavity structure such that said transducer element of adjacent integral cavities couple electrical signals of alternating phase.

BRIEF DESCRIPTION OF THE DRAWINGS

Further features, aspects and advantages of the apparatus and methods of the present invention will become better understood with regard to the following description, appended claims, and accompanying drawings where:

FIGS. 1C-1 is an exposed side portion view of unitary string saddle system 100' having embedded ground or negative circuit path or bus 32' that couples a respective electrical coupling point at each transducer cavity 120' to a top ground surface conductive coating.

FIGS. 1C-2 is an exposed side portion view of unitary string saddle system 100' of FIGS. 1C-1 however, without the radial articulations 75 of the saddle body surface structure.

FIG. 2 shows an exploded view of the string saddle system shown in FIG. 1.

DETAILED DESCRIPTION OF THE EMBODIMENTS

The present invention provides a stringed musical instrument pickup comprising a plurality of electro-mechanical structures that are integrated with a saddle or saddle segments. The saddle or saddle segments comprise articulated cavities beneath each individual string. A top saddle strip supports tensioned strings over a vertically compliant area of the cavity. The articulated cavities are part of a body portion beneath top saddle portion. Preferably, the top saddle strip and body portion is a single unitary structure. The body portion has opposing surfaces. Each cavity includes a flexurally responsive transducer element suspended between two mounting points, or suspended at one end from one mounting point. Each transducer element is mechanically and electrically coupled at coupling points via conductive elastomer pads or using a conductive mounting agent such as a conductive epoxy. In alternate embodiments, the transducer element is mechanically coupled at separate mechanical coupling points with electric coupling provided at separate electrical coupling points. The vertically compliant area of the cavity provides a vertically biased area of sensitivity within the saddle/saddle segment corresponding to each string. Vertical displacement of this area of sensitivity below the saddle is transmitted to the horizontally suspended transducer via the pad, e.g., at a mechanical coupling point. The transducer converts this displacement from vibratory energy to an electric signal for each respective string, and is driven by the relative differential in mechanical input between the coupling to the area of sensitivity via the elastomer pad, and the rigid mounting ledges. In one embodiment, the saddle is of a laminated construction and contains four layers of circuit paths. Positive (embedded layer) circuit paths and negative (outside surface layer) circuit paths index to precise points in the body structures (inner cavity surfaces) corresponding to the mounting and conducting points, and determining the alternating and unitary phasing arrangement of the transducers.

First Embodiment

Figure 1:
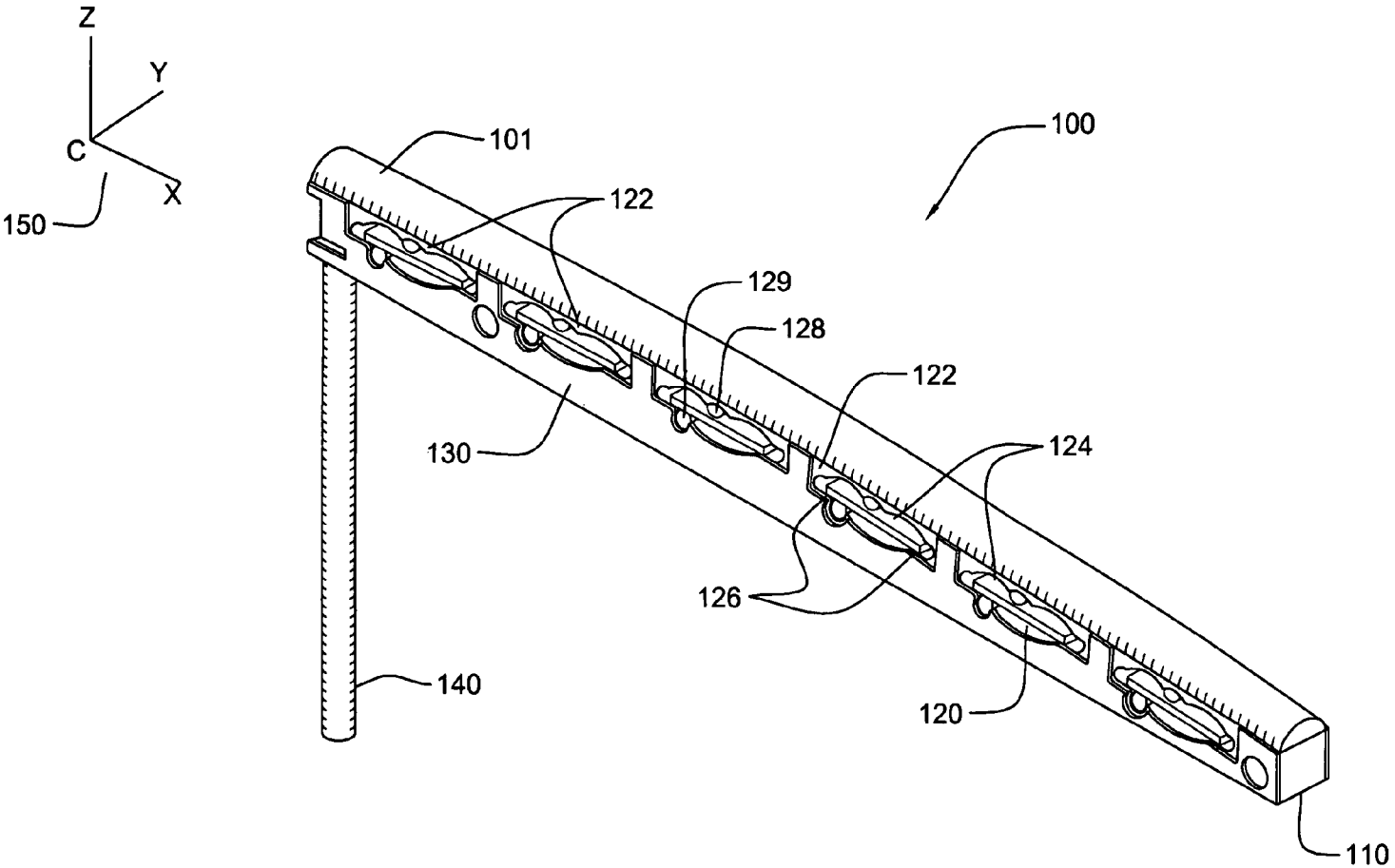
FIG. 1 shows a unitary string saddle system according to an exemplary embodiment of the present invention.

FIG. 1 shows a unitary string saddle system 100 according to an exemplary embodiment of the present invention. Top saddle strip 101 supports the tensioned strings (not shown) over the body portion 110. Body portion 110 comprises a laminated construction of printed circuit board or like materials, e.g., copper clad FR4, or may comprise similar structures for embedding a circuit path of conductor material such as copper. Within the body portion there is further included a plurality of embedded cavity structures 120 located in articulation with a respective string. In the embodiment depicted, there are 6 cavity structures 120; one for each string on a six-string musical instrument such as a guitar. The body portion 110 also comprises two opposing surfaces described in further detail in the following figures. Cavity structures 120 define and form a vertically compliant area of sensitivity 122 in the body portion that is responsive to vibratory energy from the corresponding string. Each vertically compliant area 122 extends vertically from the top saddle strip 101 beneath the respective string to top of cavity structure 120, and extends horizontally as defined by the length of the cavity structure 120.

Figure 1A:
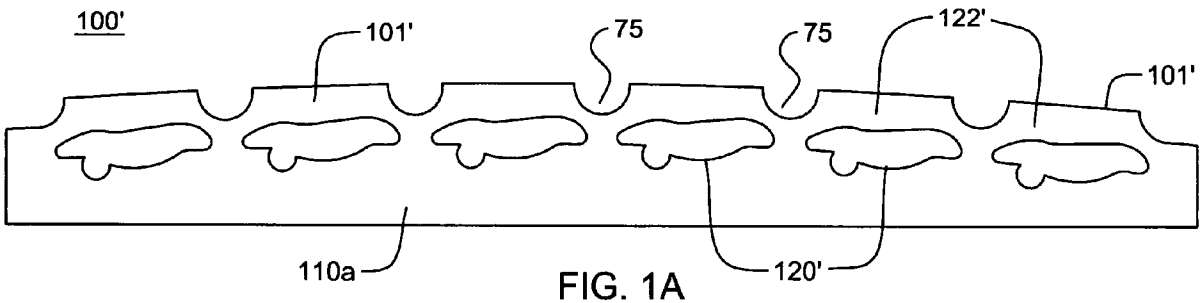
FIG. 1A shows an exposed side portion of unitary string saddle system 100' of unitary structure having top saddle portion integral with and formed from the same Printed Circuit Board (PCB) body or like material substrate according to one embodiment.

FIG. 1A shows one side body portion 110*a* of a unitary string saddle system 100' of unitary structure having top saddle portion integral with and formed from the same PCB body or like material substrate. That is, the top saddle/string support structure area is integral to and constructed from the same piece of material(s) as the lower portion of the saddle structure to create a much stronger, unitary structure and eliminate multiple fabrication steps involved.

The saddle 100' of unitary structure includes machined cavity structures 120' within the body 110 as in FIG. 1A defining same individual vertical compliant areas 122' of sensitivity. Further, as shown in FIG. 1A, in one embodiment, the integral top saddle portion includes individual top saddle/string support areas 101' upon which a respective individual musical instrument string is tensioned. Each top saddle/string support area 101' is defined lengthwise by grooved areas or notches (also referred to herein as radial articulations) 75 disposed on each side of a string. These grooved areas 75 increase the flexibility and vertically compliant sensitivity of the individual string support structure areas to the vibrations from the strings. By increasing the size of the grooved areas 75, the support areas of the structure become less rigid and thereby increases the sensitivity of individual string segments vertical responsiveness to corresponding individual string vibrations. This enables additional fine tuning of individual string output balances.

Thus, for example, as shown herein with respect to FIGS. 1B-1F the numbered arrows 33 that point to embedded circuit path point to the general string support area in the body structure that becomes thinner when the groves are expanded horizontally and/or vertically. For example, the wider and/or deeper the grooves, the thinner the area (e.g., wall thickness) supporting the top string support structure becomes, and the more flexible and therefore sensitive to vertical string vibrations. In design, a balance is struck between sensitivity of the structure and retaining sufficient structural integrity to support the tensioned strings.

Further, the sensitivity of a vertically compliant roof area of the cavity can be increased or attenuated via the thickness of the roof section of each cavity structure 120'. Moreover, as shown in FIG. 2, and, in greater detail of the cavity shown in FIGS. 5A-5C, horizontal elongation slots 227 are provided on either or both sides of each cavity 220 which adjusts the degree of vertical sensitivity for the cavity/vertically compliant area of sensitivity. This further enables passive electro mechanical balancing of the string outputs relative to each other.

Each cavity structure 120, 120' further includes a flexurally responsive transducer element 124, which is suspended in a beamlike fashion between mounting points 126 formed within a lower surface of each cavity. In example embodiments, the flexural transducers include bender, or bimorph type transducer elements which are a laminate of two piezo ceramic plates with a metal center vane sandwiched between them. Bender or bimorph type transducers are designed to be excited flexurally as opposed to by compression (which is what is typically used for plucked stringed instrument pickups). A unimorph type transducer could also be employed, which is one piezo plate laminated onto one side of a piece of brass. Basically any type of rigid, flexurally responsive transducer element which can be mounted in a beam or cantilever fashion, with exposed, polarized conductive electrodes on its opposing surfaces, could be employed.

As shown in FIG. 1, transducer element 124 is mechanically and/or electrically coupled at coupling points by conductive elastomer pads 128 and 129 which may comprise sections of extruded, conductive rubber cord or, by an equivalent conductive mounting means, e.g., a predetermined amount of conductive adhesive material, e.g., a conductive rubber glue or soft cure conductive epoxy of suitable viscosity and durometer. Conductive layer 130 formed on opposing surfaces of body portion 110 is one among a plurality of conductive elements forming positive and negative circuit paths, further described in subsequent figures. Bisected holes pass through the embedded circuit paths and also meet the external ground planes 130 on the outside faces of the body portion, thereby exposing positive and negative circuit contact points within the holes, as seen in FIG. 2. A shielded audio cable 140 is affixed to the saddle system with adhesive and the positive and negative connections are made to their respective contact points via solder or conductive adhesive.

In the integral top saddle embodiment of FIG. 1A, because the top saddle/string support areas 101' are now integral to the bottom structure, an alternate variation on the embedded circuit deploys the negative circuit paths to the transducers, as will be described in greater detail herein below.

Referring to the embodiments depicted in either FIG. 1 or FIG. 1A the respective separate top saddle strip 101, or integral top saddle portion 101' is the load bearing part of the structure that supports a tensioned string of an instrument. The saddle portion 101, 101' thus transmits vibrations induced in the string of the instrument to the respective vertically compliant area 122, 122' of the saddle body portion immediately below. The vibrations may be induced by plucking the string, bowing, or any other means. The cavity 120, 120' in the body portion 110, 110' is in essence an elongated slot. The physical dimensions of this slot 120 are dictated by the size of the saddle, depending upon the type of stringed instrument in which it is installed. Generally, the more elongated the cavity 120, the more sensitized the vertically compliant area 122. In other words, string to string output balances may be calibrated mechanically by elongating the individual articulated cavities 120 horizontally. This increases the degree of vibratory compliance of the individual vertically compliant area and thus increases the amount of vibratory energy conveyed to the associated transducer 124. The result is louder output for that particular string. The optimal size is a balance between sensitivity and structural integrity (to protect the delicate transducer element within) depending on the appropriate application.

In view of FIG. 1, the upper pad 128 of the two small, conductive elastomer pads mechanically couples a point on the underside of the vertically compliant area 122, to a point on the suspended transducer 124 below. In one embodiment, the pad 128 is nested and compressed into the vertically compliant area of the saddle. In another embodiment, the pad 128 is compressed between a ramped roof area on the underside of the vertically compliant area of the saddle. The upper pad thus mechanically couples the vertical area of sensitivity 122 to the horizontally suspended, flexurally responsive transducer element 124. The upper pad additionally provides electric coupling of the top surface of the transducer element to a positive (or negative circuit path depending on the phasing of the adjacent transducers), as shown in the exploded view of FIG. 2. This helps to avoid phase cancellation effects between adjacently mounted transducer elements in one embodiment.

Figure 5A:
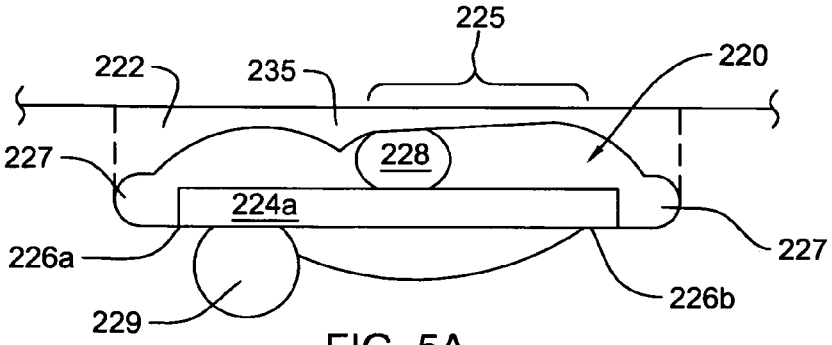
FIGS. 5A-5F illustrate more detailed views of the cavity structure 220 and various methods for electrically and mechanically coupling the transducer element 224 within each cavity.
Figure 5B:
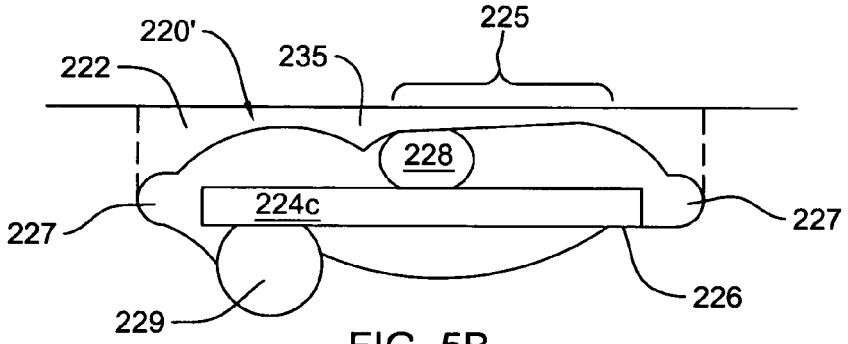
Figure 5C:
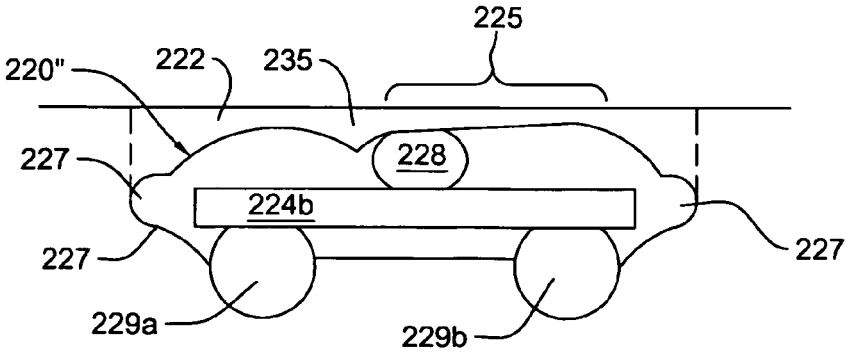

The lower of conductive elastomer pad 129 also makes an electrical connection between the bottom face of the transducer and the ground/negative plane or to the positive circuit path depending on the phasing of the transducer 124. The lower pad is only an electrical coupling in the optimal embodiment. The lower pad does not have to mechanically couple the transducer to any vibratory input. In alternate embodiments, as shown in FIGS. 5A-5C, the lower pad(s) could function as a soft ledge, supporting one or both end(s) of the transducer in place of the rigid ledge(s). The negative electric coupling is provided to alternate cavities, as shown in FIG. 2 to provide an alternating phase relation of adjacent transducers (cavities) in one embodiment.

The transducer elements 124 receive vibratory energy from the vertically compliant area of sensitivity via the mechanical coupling provided by the upper elastomer pad 128, and convert the vibratory energy to electrical energy. The transducer is driven by vibrations from the vertically compliant area via the coupling pads. The transducer responds to the relative differential in mechanical input between the coupling to the area of sensitivity via the elastomer pad, and/or the rigid mounting ledges, or combinations thereof. In one embodiment, shown in FIG. 1, the transducer element is mounted between the two rigid mounting ledges 126 formed on bottom cavity surface.

FIGS. 5A-5F illustrate more detailed views of the cavity structure 220 that may be implemented in both the unitary saddle and top saddle strip saddle designs for guitars, violin and other stringed musical instruments, and various methods for mounting of the transducer 224. As shown in FIG. 5A, the lower inner cavity surface includes two rigid ledges 226*a* and 226*b* upon which the transducer element 224 is beam mounted, i.e., ledges provides the bottom mechanical coupling to the cavity. In the embodiment depicted, the coupling pads 228, 229 provide electrical coupling of the transducer to the circuit paths.

In FIG. 5B, the lower inner surface of cavity structure 220' includes a single ledge 226 upon which the transducer element 224 is cantilever mounted, i.e., provide cantilever support because it is anchored on one end to a rigid surface (ledge 226). In the embodiment depicted, the coupling pads 228, 229 provide electrical coupling of the transducer to the circuit paths. However, in this embodiment, only one rigid transducer mounting ledge is provided and a bottom coupling pad 229 provides a soft support beneath the cantilever mounted transducer. Top elastomer conductive pad 228 provides mechanical coupling to the vertical compliant areas 222, and further electrical coupling to a circuit path as will be described herein below.

In FIG. 5C, the lower inner surface of cavity structure 220" has eliminated the rigid ledges upon which the transducer element 224 is mounted; rather, the transducer element is beam suspended upon two bottom mounting pads 229*a*, 229*b*. In this embodiment, both the bottom coupling pads 229*a*, 229*b* provide soft support beneath the beam mounted transducer. One or both of these pads additionally provide electrical coupling to the circuit paths as will be explained in greater detail herein. Top elastomer conductive pad 228 provides mechanical coupling to the vertical compliant areas 222, and further electrical coupling to a circuit path.

Cantilevered Transducer with Conductive Pads

Figure 5D:
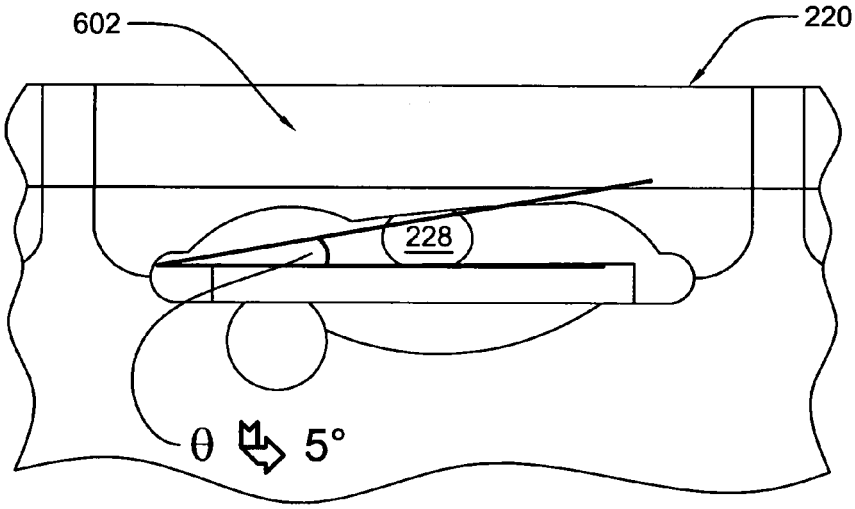
Figure 5E:
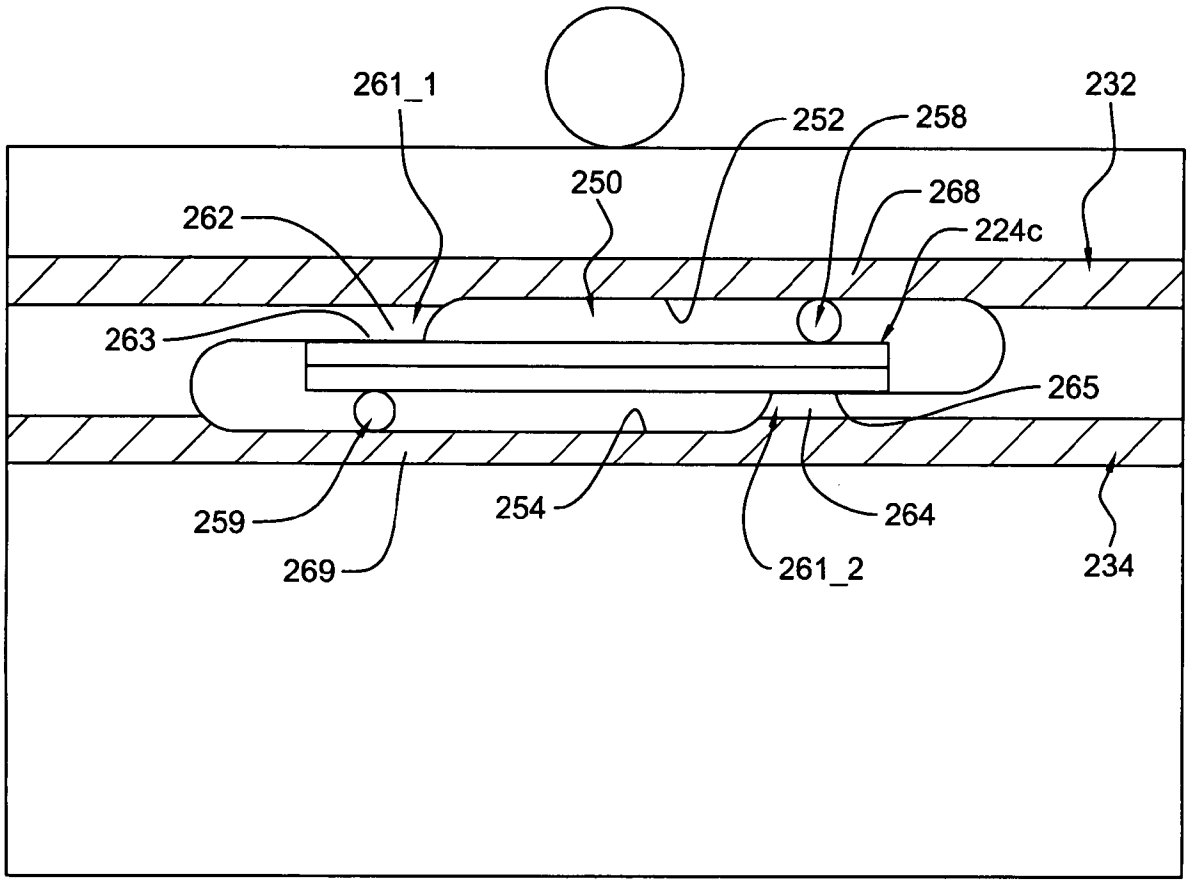

In an alternate embodiment, as shown in FIG. 5E, machined into the saddle bridge (or individual saddle piece when provided in a kit) is a horizontally-oriented cavity structure 250 that is in the shape of a flattened z-shaped slot or opening having substantially horizontal upper surface 252 in which an upper cavity ledge 262 is formed and upon which a transducer element 224*c* (e.g., a bimorph) is cantilever mounted at a first end, and, further a flattened substantially horizontal bottom surface 254 in which a lower cavity ledge 264 is formed and upon which transducer 224*c* is cantilever mounted at a second end. That is, the lower ledge 264 is the anchoring point for the cantilever mounted transducer and the upper ledge 262 is the mechanical driving/input point. In a first embodiment, the transducer is mounted as a cantilever with conductive pads. For example, of the opposing ledges 262, 264, the lower cavity ledge 264 anchors the transducer in isolation from the upper cavity ledge 262 which provides the mechanical input to the transducer from the vertically compliant top portion of the saddle which supports the string. Embedded circuit paths and conductive pads are used for electrically coupling each circuit path to the transducer element 224*c*. In this embodiment, for example, upper elastomer pad 258 provides conductive path from top surface of transducer 224*c* to a formed electrical coupling point 268 that connect to the embedded positive circuit path 232 and, lower elastomer pad 259 provides a conductive path from bottom surface of transducer 224*c* to a formed electrical coupling point 269 that connects to the embedded negative (e.g., ground) circuit path 234, e.g., at adjacent or at alternating string positions (adjacent or alternating cavities depending on the transducer cavity phasing relation).

Cantilevered Transducer with Non-Conductive Pads

In another embodiment, non-conductive pads may be used to press the transducer up against exposed conductive coupling areas located on each mounting ledges which provide both mechanical and electrical coupling. In this embodiment of FIG. 5E, cantilevered support is provided for the transducer 224*c* at the first of the transducer is the bottom elastomer pad 259 that supports the transducer element at a first end against upper cavity ledge 262. Alternately or in addition, providing additional cantilevered support for transducer 224*c* at the second end against lower cavity ledge 264 is the top elastomer pad 258. In the embodiment shown in FIG. 5E, in which the saddle is of unitary design (no separate top saddle portion supporting string) elastomer pads 258, 259 may provide only mechanical support, i.e., are non-conductive and thus are used to press the transducer up against exposed conductive coupling areas on the mounting ledges. In this configuration, the electrical coupling points for transducer element 224*c* are being provided at exposed surfaces of each ledge 262, 264. Then, conducive paint or adhesive may be provided at each ledge surface that is electrically coupled to a respective positive or negative (ground) embedded circuit path. For example, conductive paint and, or in addition, conductive adhesive material, e.g., Copper clad FR4 epoxy glass composite material, is applied at an inner cavity surface of upper ledge 262 to form an electrical coupling point 263 that connects with the embedded positive circuit conductive path 232 in one embodiment. In such configuration shown in FIG. 5E, conductive paint and, or in addition, conductive adhesive material is applied at an exposed inner cavity surface of lower ledge 264 to form an electrical coupling point 265 to the negative (e.g., ground) circuit path 234. In this embodiment, the conductive paint or adhesive may extend on external cavity surfaces from each coupling point to its respective positive or negative circuit path portion. For example, the conductive paint is placed on the inner cavity wall 252 surface where the circuit is exposed. The conductive paint increases the contact area for the conductive pad coupling. As a further example, conductive paint/adhesive may extend from coupling point 263 to positive circuit path 232 along outer surface 261_1, and similarly, conductive paint/adhesive may extend from coupling point 265 to an negative circuit path 234 along outer surface 261_2. Alternately, the embedded printed or laminated conductive path(s) (forming positive circuit path (s)) formed on inner surfaces of the saddle body side portion extends internally to each coupling point and is exposed at an interior ledge cavity surface at a location of a respective coupling point 263, 265 at such time as when forming the cavity structure by machining the saddle body portions.

Cantilevered Transducer with No Pads

Figure 5F:
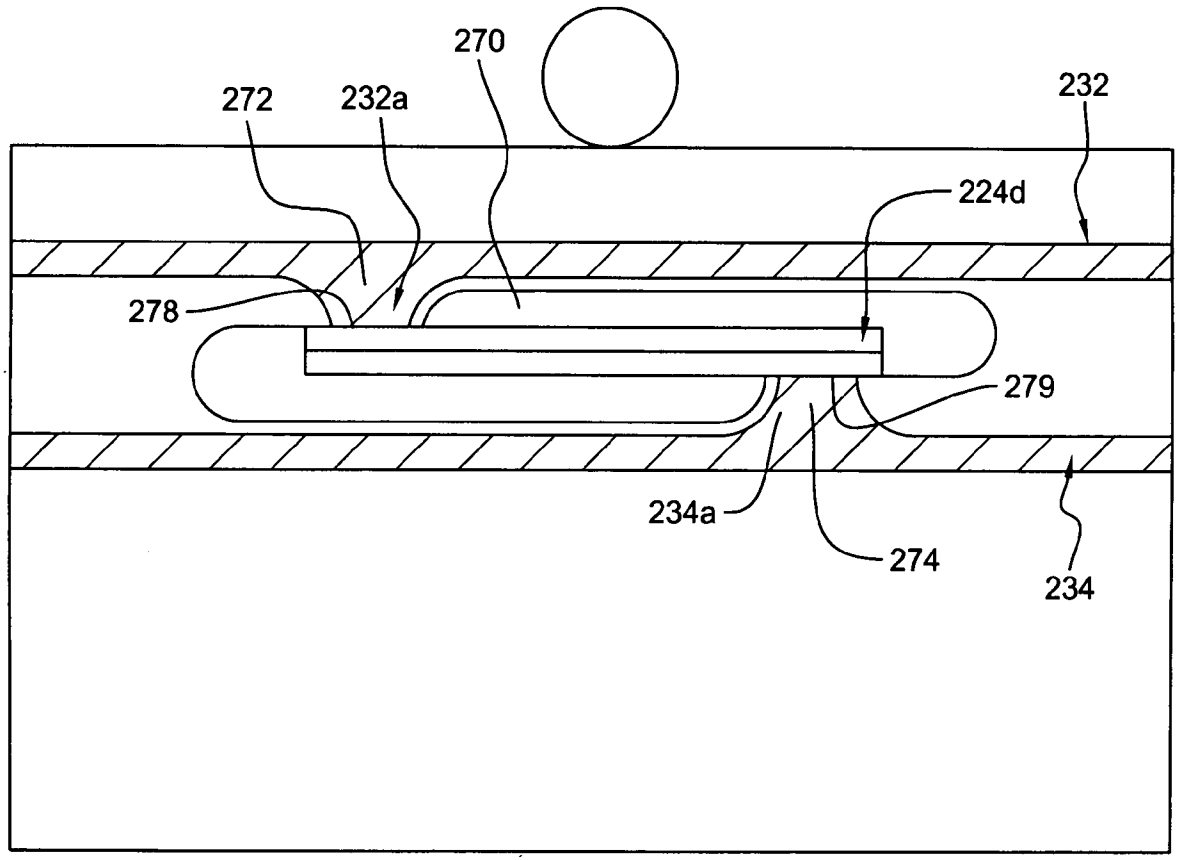

In a further alternate embodiment, for the unitary design embodiment, as shown in FIG. 5F, a horizontally-oriented cavity structure 270 shaped as a flattened z-shaped opening or slot having upper cavity ledge 272 and lower cavity ledge 274 supports a transducer element 224*d* (e.g., a bimorph) without use of elastomer pads as in the embodiment in FIG. 5E. In such an embodiment there is provided direct electrical coupling at the mechanical coupling ledges via conductive adhesive. That is, transducer element 224*d* is mounted at each end to a respective ledge surface 272, 274 by a conductive adhesive which form respective electrical coupling points 278, 279. In this embodiment, the adhesive functions as an electrical coupling point to exposed portions of the embedded positive and negative circuit paths 232, 234 on the inner cavity surface that couple to transducer element 224*d* at formed electrical coupling points 278, 279 of conductive adhesive.

The saddle system, by way of its internal cavity structures is directionally sensitive to vertical string vibrations conveyed along a single axis, e.g., on its positive Z axis. It is highly desensitized to vibrations from below, or negative Z axis direction. There is also very little sensitivity on the X and Y axis because the rebated areas in the saddle, on both sides of each vertically compliant area isolate the sensitized vertically compliant areas from the walls of the saddle slot, and the sensitized, receptive area of the suspended transducer is coupled only to the isolated vertical compliant area. This directional sensitivity decouples the pickup system from the top surface of the body of the instrument, thus providing a non micro-phonic relationship to the resonant instrument top. The lack of micro-phonic sensitivity reduces feedback and eliminates the amplification of spurious body noise from handling of the instrument. This yields a very clear, and focused sounding audio signal from each string.

Figure 6:
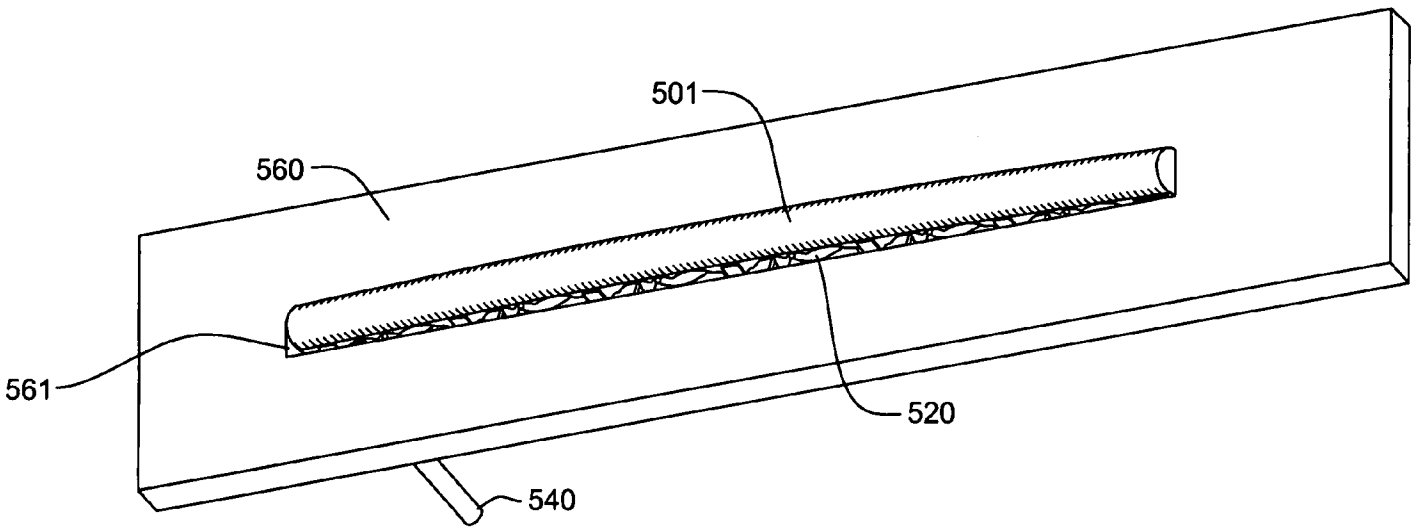
FIG. 6 shows a unitary string saddle system placed within a saddle plate slot, according to an exemplary embodiment of the present invention.

In addition, the front and back face of each vertically compliant area are free to vibrate by way of clearance pockets on the front and back face of the saddle corresponding to the areas of sensitivity. These rebated areas prevent the sensitized areas of the structure of the cavity from contacting the sides of the slot in the saddle plate in which the saddle is mounted, as shown in FIG. 6. This prevents the sensitized areas from being mechanically damped by being forced against the walls of the saddle slot from the forward pressure from the tensioned strings. The rebated areas also decouple the areas of sensitivity from the walls of the bridge plate saddle slot.

FIG. 2 shows a detailed exploded view of the components of the saddle system depicted in FIG. 1. As described earlier, string saddle 201 supports tensioned strings (not shown) over a body portion, comprising two portions 210. The bottom surface of string saddle 201 is coupled to the top surfaces of body portions 210 that, in one embodiment, comprise single printed circuit board (PCB) layers 210*a*, 210*b* that when mated form a unitary body portion of laminate construction having internal cavities 220 and embedded circuit portions therein. In this embodiment, each body portion 210*a*, 210*b* further comprises, apart from the top surface, an outer and an inner surface. A grounding plane 230 is attached to the top surface and outer surfaces of each body portion 210*a,b*. For this circuit, one embedded inner circuit path is provided; that is, body portions 210 include an embedded (or laminated) positive circuit path 232 for electrical coupling to said transducer with negative (e.g., ground) circuit path contacts 234 provided within the cavity structure at alternating string positions for coupling to said transducer. The embedded circuit paths can be etched, machined, silk screened or otherwise formed or deposited onto a surface or layer laminated on a side saddle body surface within the structure of the bridge or string support structure(s). The circuit path may be on an exterior surface(s) of the string support structure(s) and then be protected with a paint coating. These circuit paths are further described below.

Body portions 210*a,b* further comprise a plurality of cavities, two of which are represented by 220. The cavities, by way of their structure, define and form a vertically compliant area of sensitivity 222 for each respective string. Transducer elements 224 are mounted within the cavities, held in place by mounting points in a beamlike fashion, and are electrically and mechanically coupled to the top and bottom surfaces of the cavity. Additionally the transducers may be glued or epoxied in place at one or both ends to the mounting points, i.e., cavity bottom inner surface ledges. In one embodiment, the mounting points are located at ledge portions formed along the horizontally elongated cavity. The top surface of a transducer element 224 is mechanically coupled to the bottom surface of the vertically compliant area 222 of the cavity housing the transducer element via conductive elastomer pads including bottom pad 228 and top pad 229. In one embodiment, the pads are fitted into respective bisected holes or mounts 239 and/or arch shaped (e.g., concave) nest 238, located and formed as part of the lower bottom inner cavity surface (pad 239) and upper inner cavity surface (pad 238). However, as described in greater detail herein with respect to the embodiments of the cavity shown in FIGS. 5A-5C, the inner top surface of each cavity is ramped to enable adjustment of compression on and position of top coupling pad.

That is, in each of the embodiments described in connection with FIGS. 5A-5C, rather than an arch shaped nest 238 for accommodating mounting of the top coupling pad the roof (as shown in FIG. 2), each of the cavities may include a ramped shape top roof portion 225 that includes a half radius 235 which acts as a stop. This allows for some adjustment of the degree of compression of the top coupling pad 228 that electrically and mechanically couples the transducer element 224 within the cavity. The angle of the cavity roof ramp relative to the transducer top horizontal surface ranges anywhere between about 2.5 to 7 degrees relative to the top transducer surface. FIG. 5D illustrates a detailed view of the cavity structure 220 showing the angle of the cavity roof ramp relative to the transducer top horizontal surface as about 5 degrees. It is understood that an optimal angle will depend on the diameter or size of the coupling pad, the durometer of the elastomer of the pad and the degree of coupling/compression needed in order to achieve the desired level of output performance. In one embodiment 0.060 diameter pads may be used. A steeper angle will obviously increase the degree of compression of the pad however, a balance is struck here because too much compression may break a suspended transducer element.

Preferably, each top ramped roof portion is coated with a conductive paint to increase the conductive surface area between the embedded circuit (at the electrical contact point) and the conductive pad.

Figure 3A:
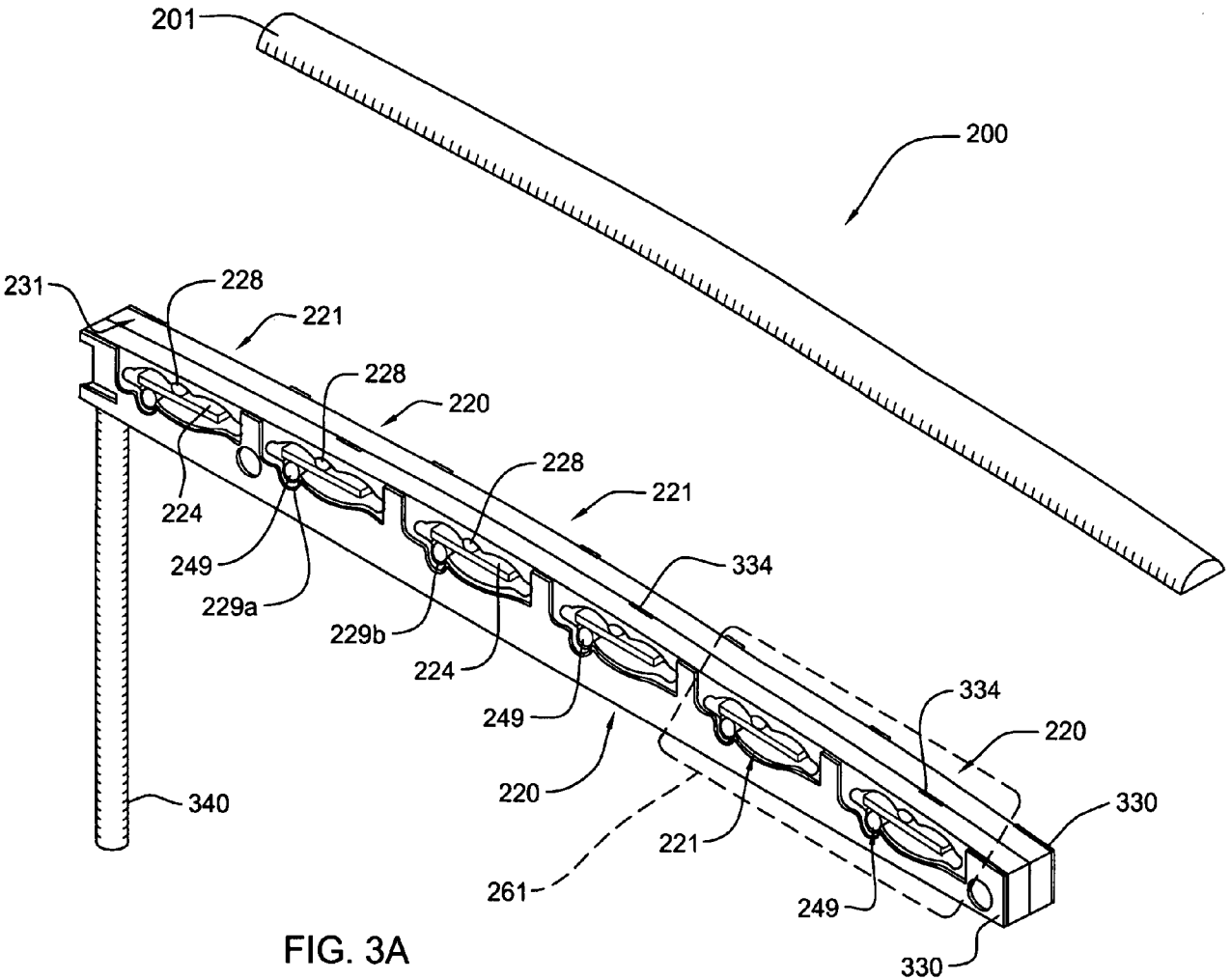
FIG. 3A shows a partially assembled view of the string saddle system shown in FIGS. 1 and 2.

As shown in FIG. 3A, each transducer element 224 in each cavity has a connection to both the positive and negative circuit paths via top conductive pad 228 and bottom conductive pad 229 in alternately phased configuration. Thus, the bottom conductive pads couple a bottom transducer surface to either a negative or a positive connection at respective alternate cavities, and, likewise, the top conductive pads couple a top transducer surface to positive or a negative positive connection at respective alternate cavities.

More particularly, in accordance with the present invention, as shown in the exploded view of FIG. 2, the saddle system includes four layers of circuit paths. There is an embedded positive polarity circuit path 232 containing positive contacts 233. There are three negative circuit paths that also act as ground planes for EMI shielding. Ground planes 230 are deposited or formed onto the outside surfaces of the body portions 230, and ground planes 231 are deposited or formed onto the top surfaces of the body portion. The ground planes 230 and 231 formed on the top surface and each opposing surface form a shield in the form of a Faraday cage, providing a shield from electromagnetic interference. The bottom surface of the body structure 210 may also be coated with a conductive coating to increase the faraday cage shielding effect. As further shown in FIG. 2, the saddle system includes embedded negative contacts 234 for coupling top coupling pad structures of alternate cavities to the ground plane for respective alternate strings. In one embodiment, the embedded positive conductor and negative ground planes are formed of copper, brass or a like conductive material. In one embodiment, the entire outside conductive surface (ground plane) may actually be a shaped conductive (copper or brass) shim bonded to the saddle body surface instead of being machined from the surface. In an alternate uniphase embodiment, described herein with respect to FIGS. 1A-1C tops of the cavities may be polarized negatively with a conductive medium, e.g., conductive paint. This acts as a negative ground plane and shielding above each transducer in one embodiment.

The positive and negative circuit paths index to precise electrical coupling points in each cavity structure which correspond to the locations of the coupling pads for electrically coupling (and/or mounting) the transducer element in the cavities and determine the phasing arrangement of the transducers. Referring to a first cavity 221, as shown in FIG. 2, it is observed that, in one example embodiment depicted, embedded positive circuit path 232 in body portion 210*a* includes a contact portion 233' for electrically coupling the upper conductive elastomer pad, i.e., pad 228 in mounting structure 238', coupled to the corresponding transducer element 224 at a first (top) transducer location. Further, the negative circuit path (ground plane) 230 of outside body portion 210*b* will be in contact with the lower conductive elastomer pad, i.e., pad 229 in mounting point 239', which is not rebated, and coupled to the same transducer element at a second (bottom) transducer location. In other words, transducer in cavity 221 has its top surface positively coupled and bottom surface grounded to side wall 230 by virtue that this mounting point is not a rebated edge as shown in FIG. 3A. This configuration is similar for alternative cavities 221 shown in FIGS. 2 and 3A. However, in one uniphase embodiment, each of the bottom conductive pads are positively phased and are rebated/isolated from the outside negative ground planes.

Conversely, it will be observed that the immediately adjacent (neighboring) cavity 220 has a negative circuit path contact 234' in contact with the bisected hole (conductive pad nest structure) for an upper conductive pad coupled to the respective transducer element at a first (top) transducer location. Negative circuit contact 234' is in contact with ground plane 231 (and outside surface ground plane 230, since all ground planes are at the same potential). Further, it will also be noticed that embedded positive circuit path 232 includes positive circuit connection 233" that is in contact with the bisected hole (conductive pad nest structure) corresponding to the lower conductive pad 229 coupled to the respective transducer element at a second (bottom) transducer location. In other words, transducer element 224 in cavity 220 has its top surface grounded and its bottom surface coupled to the positive circuit path. Note that at this cavity, the outer ground plane 230 includes a rebated pocket 249 to prevent the lower conductive pad 229 from shorting the outside conductor (e.g., negative ground plane). This configuration is similar for alternative cavities 220 shown in FIGS. 2 and 3.

Figure 3B:
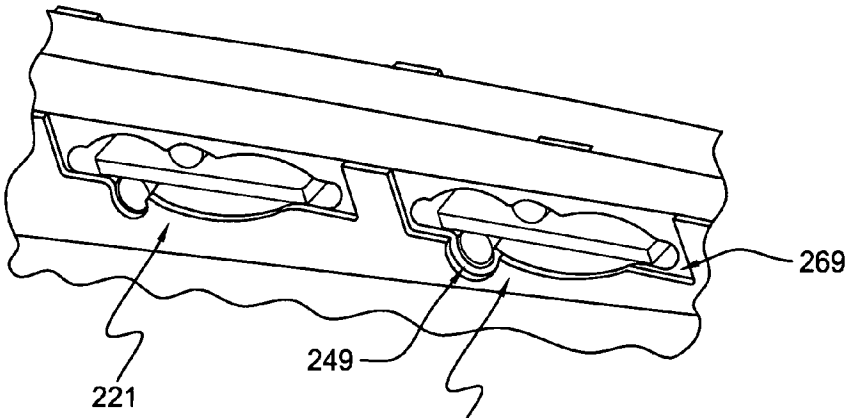
FIG. 3B shows a detailed assembled view of a string saddle cavity depicting small rebated pockets to prevent short circuiting of the transducer element therein.

FIGS. 3A and 3B further depicts two adjacent cavities 261. As shown in the detailed view of FIG. 3B, in the design of each cavity, small rebated areas 269 are provided beneath the ledge surfaces where the transducer device rests on the ledge, these small rebated areas 269 are in conjunction with the alternating lower rebated areas 249 which isolate the lower coupling pads and further prevent short circuiting of the bottom of the transducer with the outside ground plane surfaces.

With respect to the rebated pocket, in order to prevent a short circuit, the bottom conductive pads electrically coupling the transducer to the positive (embedded) circuit path (e.g., pad 229*a* shown in FIG. 3A) have a rebated edge or pocket 249 on the outside walls around the perimeter of the bisected holes to isolate the positively coupled pad 229*a* (coupled positive via the imbedded circuit path) from the negatively charged ground plane walls 330 on the outside surface of the mated body portions. That is, the rebated clearance pockets 249 around the perimeters of the bottom, positively phased coupling pads 229, i.e., the clearance between the positive pads mount and the negative external wall ground plane is necessary to prevent the shorting out of the circuit for alternative cavities 220 shown in FIG. 3A. Inversely, at each alternate cavity 221, the bottom pads electrically coupling the transducer to the negative circuit path via the outside wall ground planes 330 do not have the rebated edge as shown in FIG. 3A.

In general, referring back to FIG. 2, subsequent cavities follow this configuration whereby transducer elements in alternating cavities are coupled to positive and negative circuit paths in alternating phase relation. Following this relationship as shown in FIG. 2, for example, a next cavity (a third cavity 221) has a top surface of the transducer coupled to embedded positive circuit path 232 and the bottom surface of the transducer coupled to the negative circuit path 230 (grounded). Conversely, the fourth cavity 220 would have the top surface of the transducer coupled to the negative circuit path 230 (grounded) and the bottom surface coupled to the embedded positive circuit path 232. This alternating transducer electrical coupling arrangement repeats for every transducer below every string on the instrument in adjacent cavities to help avoid phase cancellation effects between adjacently mounted transducer elements.

Moreover, as transducer and other pickups are generally sensitive to magnetic fields generated by transformers, fluorescent lamps, and other sources of interference, pickup hum and noise generated from these sources are eliminated. That is, according to one aspect of the invention, the transducers are electrically shielded (such as by a Faraday shield formed by the ground conductors on outer body portion surfaces and on surface top), signals (i.e. signals such as hum) are eliminated.

In addition to the embodiment in FIG. 3A in the unitary saddle structure, because the top saddle area is now integral with the bottom structure, there is configured alternate variations on the embedded circuit deployed to the negative circuit paths to the transducers.

In the unitary saddle structure, the embedded circuit paths, the body structure and the top saddle/string support areas are all fabricated from a unitary piece of stock constructed of two (or more) plates laminated together. The laminated plates include the embedded positive circuit paths and negative circuit path (ground planes) on one or more surfaces as described herein. The saddle side body and top saddle portions are fabricated from composite or non-composite type materials with sufficient strength and rigidity to withstand the forces of the tensioned strings.

Uni Phase Embedded Circuit

In a uniphase circuit embodiment, a transducer element (e.g., unimorph type flexurally responsive) that has a specific polarized direction, may be employed. The polarized transducers all connect to the circuit with the same polarization orientation facing in the same direction, e.g., the positively poled direction of the transducers are all facing upwards and attached to the negative bus of the circuit.

Figure 1B:
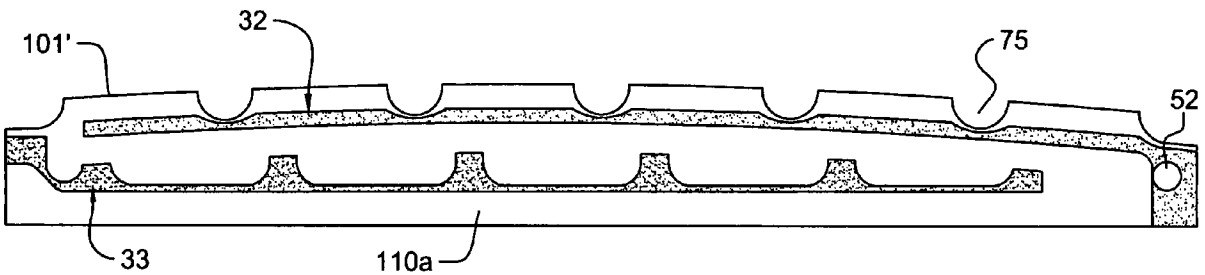
FIG. 1B shows the exposed side portion of unitary string saddle system 100' of unitary structure prior to machining cavity structures and showing embedded laminate conductive layer of uniphase circuit configuration wherein all the transducer connections are phased in the same direction relative to each other.
Figure 1C:
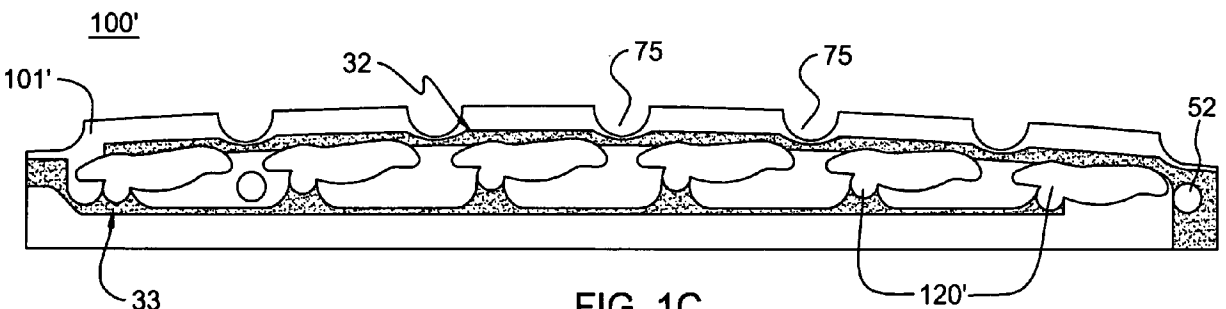
FIG. 1C shows the exposed side portion of unitary string saddle system 100' of unitary structure after machining cavity structures in the structure of FIG. 1B having uniphase circuit configuration including one embedded laminate conductive layer forming a positive bus path 33, and a second embedded laminate conductive layer forming a negative bus path 32 co-planar with the positive bus path in one embodiment.
Figures 1, 1C:
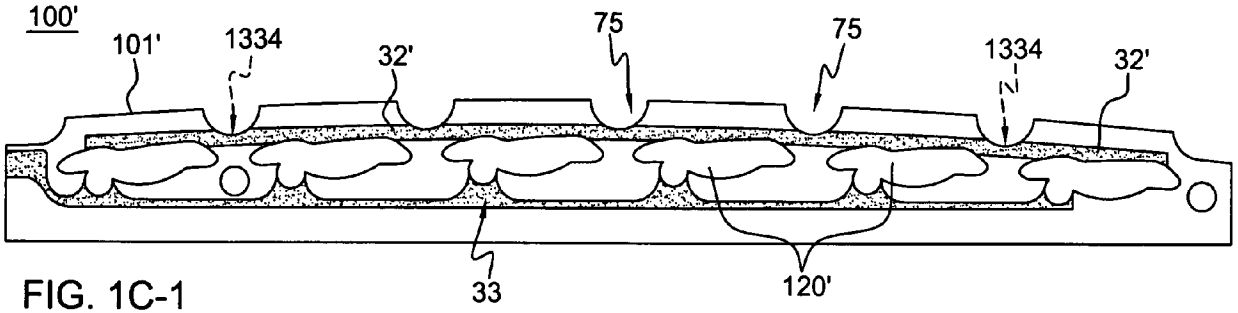
Figures 1, 1C, 2:
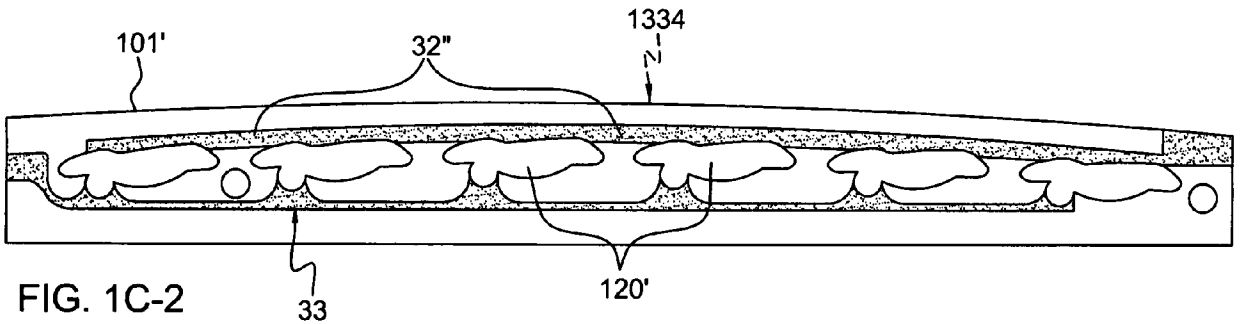

As shown in FIG. 1B, all the transducer connections are phased in the same direction relative to each other. FIG. 1B shows a resulting saddle body side portion after a manufacturing step of applying conductive paths to a surface to form conductive positive or negative (ground) planes or conductive bus paths, and prior to machining cavity structures into the saddle body, or forming a circuit trace by chemical or machining of the circuit trace from a solid, copper clad surface. Thus, for example, as shown in FIG. 1B, both a embedded circuit path 33 (e.g., positive plane) and negative embedded circuit path 32 (e.g., negative plane) are formed on a surface on the same plane of side body portion 110*a*. In one embodiment, each conductor path substantially traverses the entire length of the saddle body with the negative embedded surface path traversing a top portion of cavity structures. As shown in FIG. 1C, and a corresponding orthogonal view of FIG. 1H, after machining cavity structures 120' into saddle body 110*a*, 110*b*, for the uniphase embodiment, one embedded circuit is formed to include positive conductive bus portions 33' that are exposed at a cavity bottom surface that electrically couple lower conductive elastomeric pads (not shown) located at those exposed surfaces in the cavities 120' to one end of a respective transducer element supported within the cavity structure. Likewise, one embedded negative bus path 32 are exposed at a cavity top surface that electrically couple the upper conductive elastomeric pads (not shown) at an exposed electrical coupling point on a top surface in the cavities 120' to a transducer element. The uniphase circuit is coupled with the top negative circuit elements directly together on the same planar surface co-planar with positive plane 33.

Figure 1D:
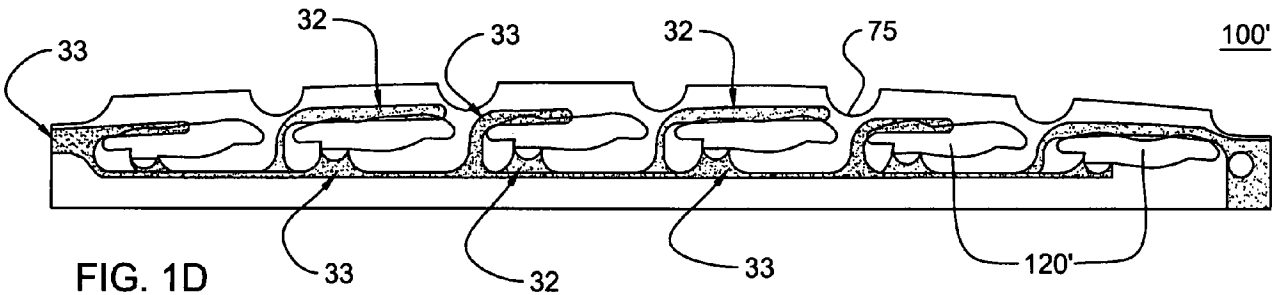
FIG. 1D shows conceptually, in an exposed side portion view, an alternating phase circuit configuration, wherein both the embedded laminate conductive layers are formed on opposite sides of body structure 110*a* with embedded alternating phase positive circuit layer 33 and embedded negative circuit layer 32 shown overlaid but (not co-planar).
Figure 1E:
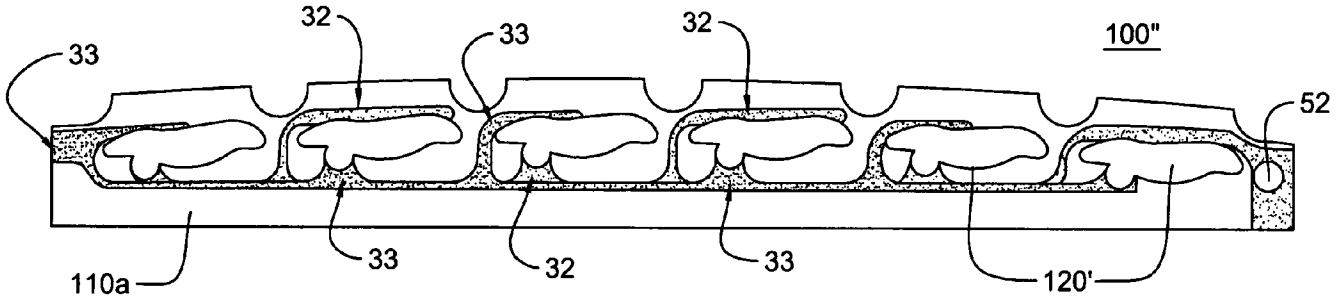
FIG. 1E depicts the resulting alternating phase positive and negative circuit layers of FIG. 1D, however as a result of further trimming by machining of the integrated cavities.
Figure 1F:
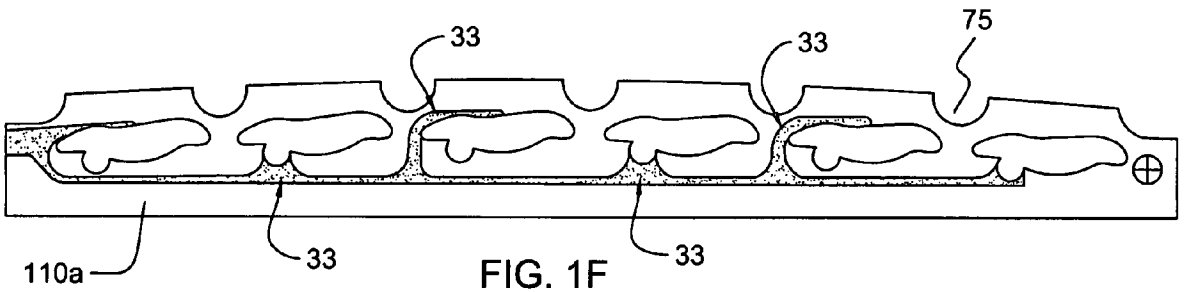
FIG. 1F depicts, for the alternating circuit configuration of FIG. 1E, only the positive circuit path 33 formed of an embedded laminate conductive layer of the unitary structure and alternating between the top and bottom transducer connections in alternate cavities.
Figure 1G:
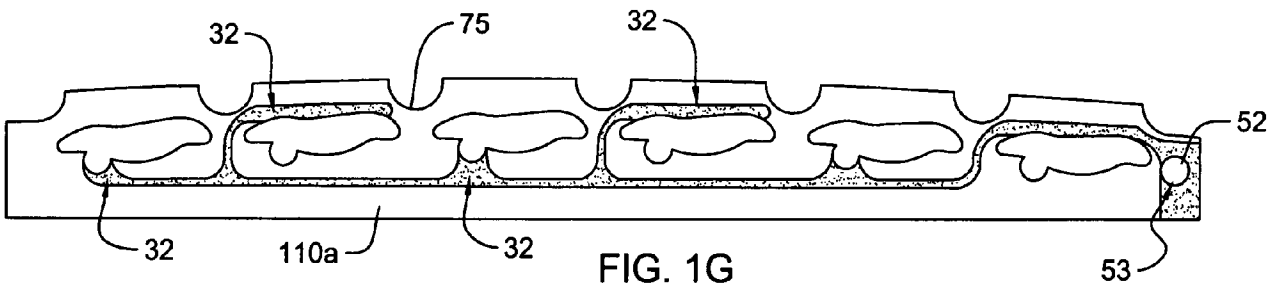
FIG. 1G shows, for the alternating circuit configuration of FIG. 1E, the negative circuit path 32 formed of an embedded laminate conductive layer on the opposite side of the laminate on which the positive circuit path is deployed on the body structure 110*a* in the view of FIG. 1F.
Figure 1H:
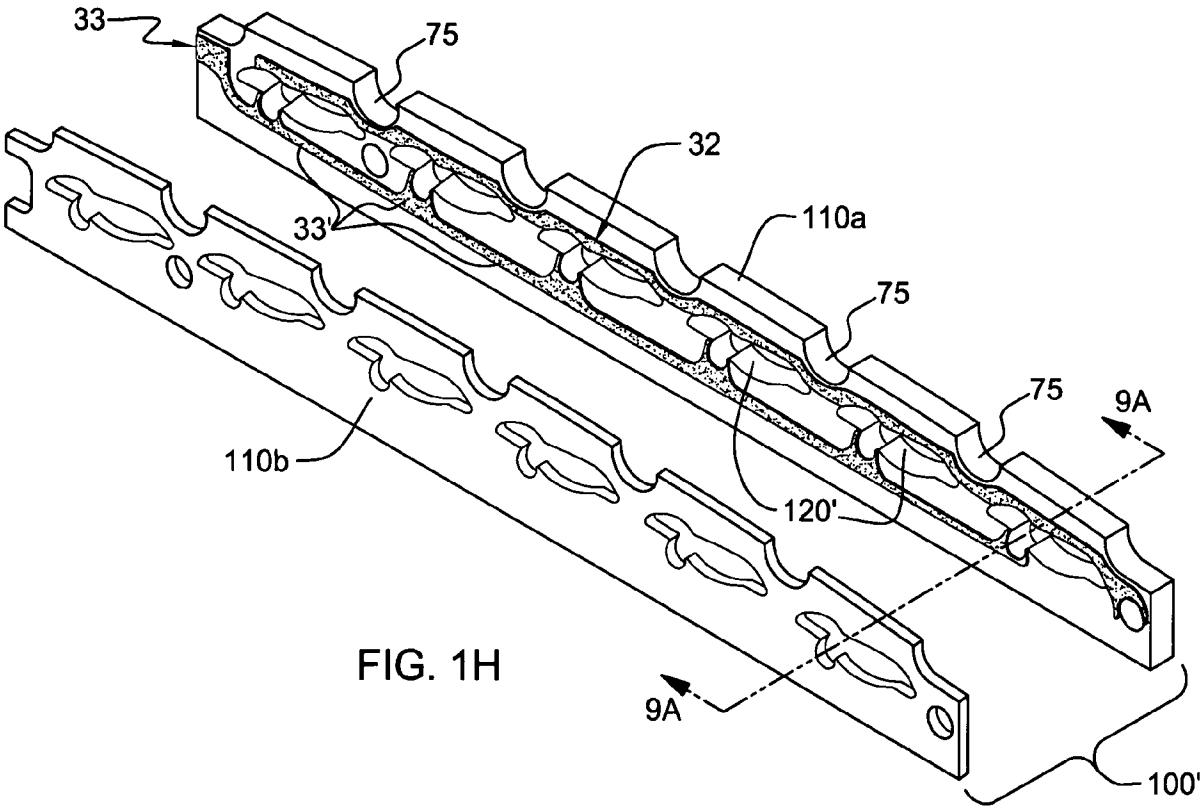
FIG. 1H depicts an orthogonal view of the unitary string saddle system 100' corresponding to the uni-circuit uni-phase embodiment of FIG. 1C including an additional side body portion 110*b* that is mated with side portion 110*a* which includes embedded co-planar circuit paths for the unitary saddle system to form unitary saddle 100'.
Figure 9B:
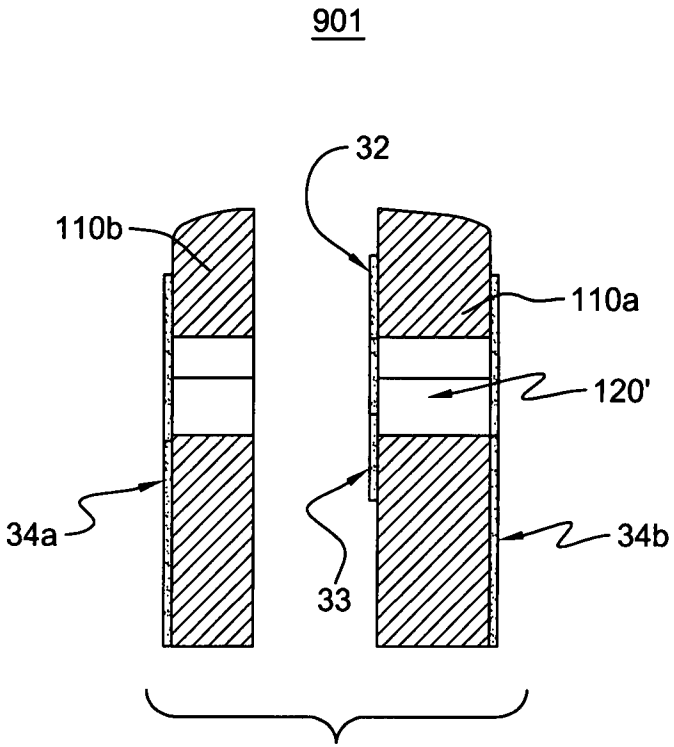
FIG. 9B depicts a side cross-sectional view 901 through a cavity structure 920 of the saddle taken along broken line 9B-9B of the embodiment depicted in FIG. 1I for a uniphase embodiment.
Figure 9A:
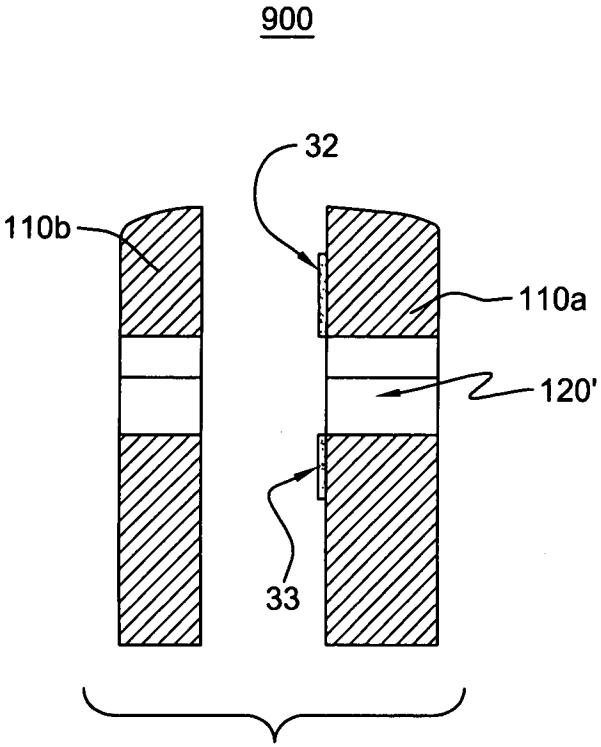
FIG. 9A depicts a side cross-sectional view 900 through a first cavity structure 920 of the saddle taken along broken line 9A-9A to delineate a saddle cross-sectional view of FIG. 1H for a uniphase embodiment.

FIG. 1H depicts an orthogonal view of the unitary string saddle system 100' corresponding to the uni-circuit uni-phase embodiment of FIG. 1C including an additional side body portion 110*b* that is mated (laminated) to side portion 110*a* to embed co-planar circuit paths within unitary saddle system 100'. FIG. 9A depicts a side cross-sectional view 900 through a first cavity structure 920 of the saddle taken along broken line 9A-9A to delineate a saddle cross-sectional view of FIG. 1H for a uniphase embodiment prior to mating (e.g., laminating) the side portions 110*a*, 110*b* together to embed co-planar circuit paths of planes 32, 33.

Uni Phase Embedded Circuit and Outer Ground Planes

Figure 1I:
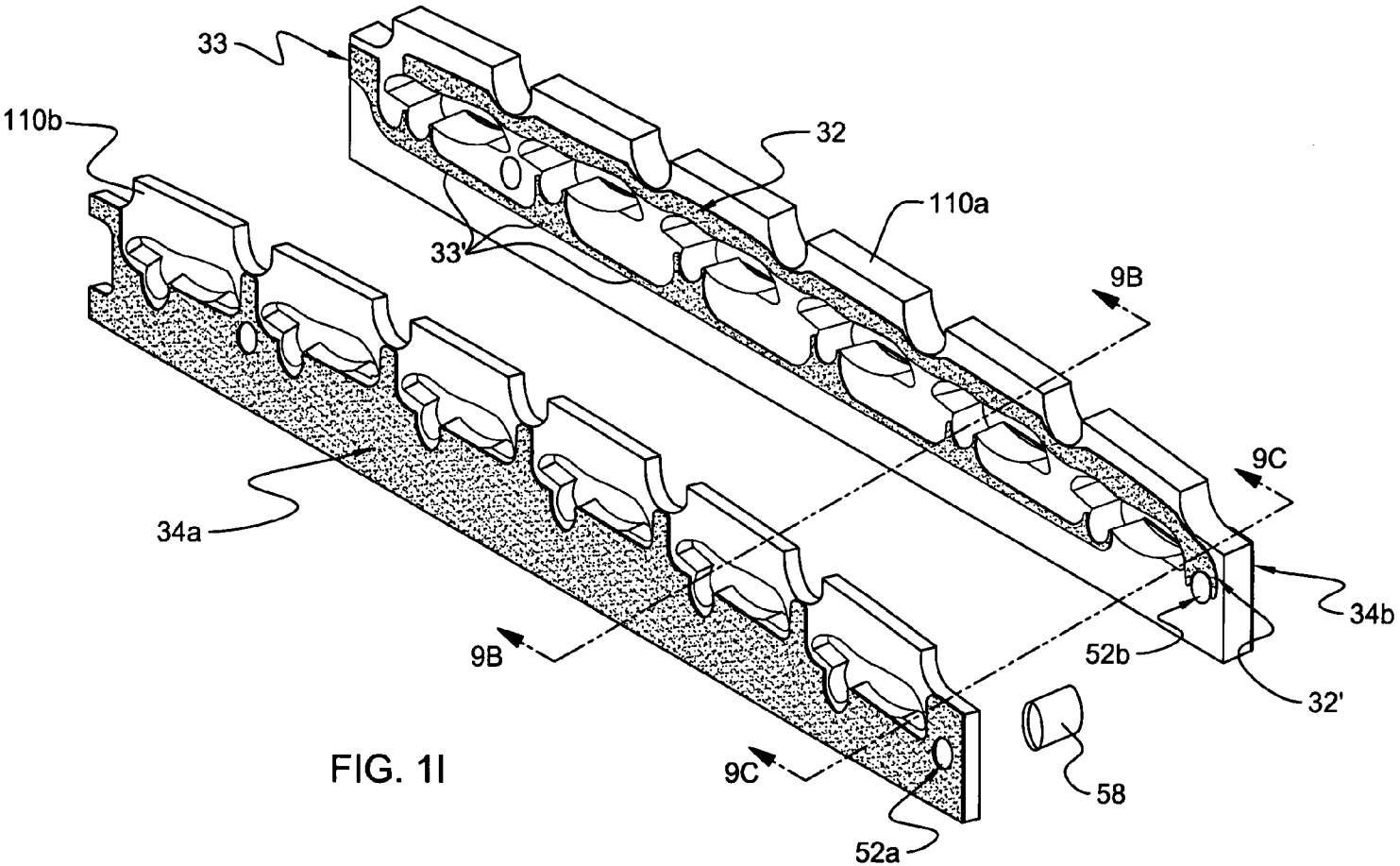
FIG. 1I shows, an orthogonal view of the unitary string saddle system 100' of FIG. 1H including one or more opposing outer sidewall conductive planes.
Figure 9C:
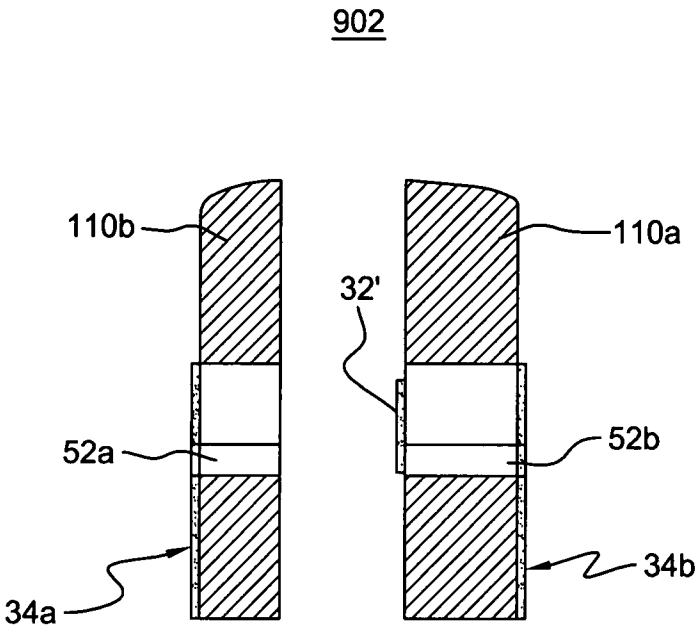
FIG. 9C depicts a side cross-sectional view 902 through an end of portion of saddle bus side portions taken along broken line 9C-9C through the pilot hole 52 of the unitary saddle embodiment depicted in FIG. 1I for a uniphase embodiment.

In one embodiment, shown in FIG. 1I, the unitary saddle body includes outer surface ground planes 34*a*, 34*b* formed on respective outer surfaces across the length of the body side portions 110*a*, 110*b*, respectively. FIG. 9B depicts a side cross-sectional view 901 through a cavity structure 920 of the saddle taken along broken line 9B-9B of the embodiment depicted in FIG. 1I for a uniphase embodiment prior to mating (e.g., laminating) the side portions 110*a*, 110*b* together to embed co-planar circuit paths of planes 32, 33 and including outer conductive planes. Further to this embodiment, the upper, embedded negative bus path 32 may be further connected to one or both outer ground planes 34*a*, 34*b* formed on each outside surface of the respective saddle body side portions 110*a*, 110*b*. For example, the formed saddle body includes at one end a pilot hole 52 comprising thru holes 52*a*, 52*b* shown formed at each side body portion. In one embodiment, one embedded circuit, e.g., negative plane 32, is formed to include embedded conductive bus portions 32' that are exposed at an interior surface of the formed hole 52*b*. When the hole 52 is machined, the embedded conductive bus portions 32' are exposed for electrical coupling to the outer ground plane surfaces via a conductive paint trace. Alternately, or in addition, a conductor device such as conductive elastomer pad 58 dimensioned to fit and extend within the pilot hole 52 formed at the saddle body end, may be used to connect each outer ground plane 34*a*, 34*b* to the embedded negative plane 33 via conductive bus portions 33'. That is, this conductive connection establishes electrical continuity between the inner and outer negative circuit paths of the device. The conductive connection of the outer ground planes to the internal ground path can also be made on the edges and or bottom of the saddle, e.g., if the embedded internal ground path is extended all the way to the edge. FIG. 9C depicts a side cross-sectional view 902 through an end of portion of saddle bus side portions taken along broken line 9C-9C through the pilot hole 52 of the unitary saddle embodiment depicted in FIG. 1I for a uniphase embodiment prior to mating (e.g., laminating) the side portions 110*a*, 110*b* together to embed co-planar circuit paths of planes 32, 33.

Uni Phase Embedded Circuit with Top Surface Ground Plane

In an alternate embodiment, the configuration of the uni phase, single plane embedded circuit configuration such as shown in than the embodiment depicted in FIG. 1C is modified such that the ground or negative circuit path connections 32' may be coupled at each transducer cavity to a conductive coating 1334 formed on the top saddle string support surface. This is alternative to the embodiment of FIG. 1I as the ground or negative circuit path or bus 32' couples to a conductive coating 1334 formed on the top saddle string support surface instead of being connected via the thru holes 52*a*, 52*b* formed at each side body portion. That is, in view of FIGS. 1C-1, the top surface of one or both saddle body portions include an applied coating of conductive material 1334 (e.g., a conductive paint). The coating creates a top shielding ground plane that may connect to the outside negative ground plane(s) at the locations where the outside ground plane extends up to the top outside surface, e.g., at locations such as shown in FIG. 1L at the articulated radii 75 between the strings. In FIGS. 1C-1, the embedded negative circuit path 32 of FIG. 1C is continuous (or may be broken with portions associated with each cavity) such that the ground or negative embedded circuit path connection 32' couple a respective electrical coupling point at each transducer cavity 120' to the top ground surface conductive coating. That is, the ground or negative circuit path connections 32 (FIG. 1C) may couple each transducer cavity to the conductive coating 1334 formed on the top saddle string support surface at any point or points along the embedded, uni-phase, top negative bus circuit path 32 of FIG. 11.

Further to this alternate embodiment, in view of FIGS. 1C-2 and as described in greater detail herein below with respect to an exposed interior plan view FIG. 1N, the radial articulations 75 of the saddle body surface structure are omitted. Thus, in this alternate embodiment of FIGS. 1C-2, an embedded negative circuit path 32" couple respective electrical coupling point at each transducer cavity 120' to the top ground surface conductive coating 1334 connecting to the outside (exterior) side negative ground plane(s).

Thus, in the further alternate embodiments, as shown in FIGS. 1C-1, 1C-2, the respective internal, uni-phase negative circuit connections 32' or 32" are connected at each cavity's electrical coupling point by having the embedded isolated negative circuit paths at each cavity or at any point or points along the embedded, top negative bus circuit path 32 of FIG. 1C extend up to and be exposed at the top string support surface for coupling with the conductive coating 1334 and thus make connection to an external negative ground plane.

Alternating Phase Embedded Circuit

In the alternating phase transducer/circuit arrangement as described herein employed in the unitary structure saddle, there is provided an additional circuit path on a separate, isolated layer within the laminated construction of the unitary body saddle structure of FIG. 1A. FIG. 1D particularly depicts both the alternating phase positive circuit layer 33 and negative circuit layer 32 shown overlaid (not-coplanar), and FIG. 1E depicts a unitary saddle 100" having alternating phase positive and negative circuit layers of FIG. 1D, however as a result of further trimming by machining of the cavities 120'. As shown in detail in FIG. 1F, the positive circuit path 33 on one embedded layer of the unitary structure, alternates between the top and bottom transducer connections in alternate cavities, and is the same as the alternating phase circuit path described herein. FIG. 1G shows, for the alternating circuit configuration of FIG. 1E, the negative circuit path 32 formed of an embedded laminate conductive layer either on the opposite side of the laminate on which the positive circuit path is deployed on the body structure 110*a* or on a separate body portion (not shown) in the view of FIG. 1F. As shown in detail in FIG. 1G, the negative circuit path 32 may be formed on a separate embedded laminate layer or on the opposite side of the laminate on which the positive circuit path is deployed as shown in the view of FIG. 1F. The separate negative circuit path layer 33, alternates between the top and bottom negative transducer connections, completing the alternately phased circuit connections for each transducer.

As mentioned earlier in connection with the uniphase embodiment, as further shown in FIG. 1E, the embedded negative circuit path 32 may connect to outside surface ground planes (not shown) via a conductive trace 53 or path within a side pilot hole 52 which intersects both outside ground planes (not shown) and the inner negative circuit path 32. The negative circuit path can also be connected to the outer wall ground planes via a conductive ground plane on the bottom or edge of the saddle in similar fashion as a top adhesive ground plane connected inside and outer wall circuit elements as described herein.

Figure 1J:
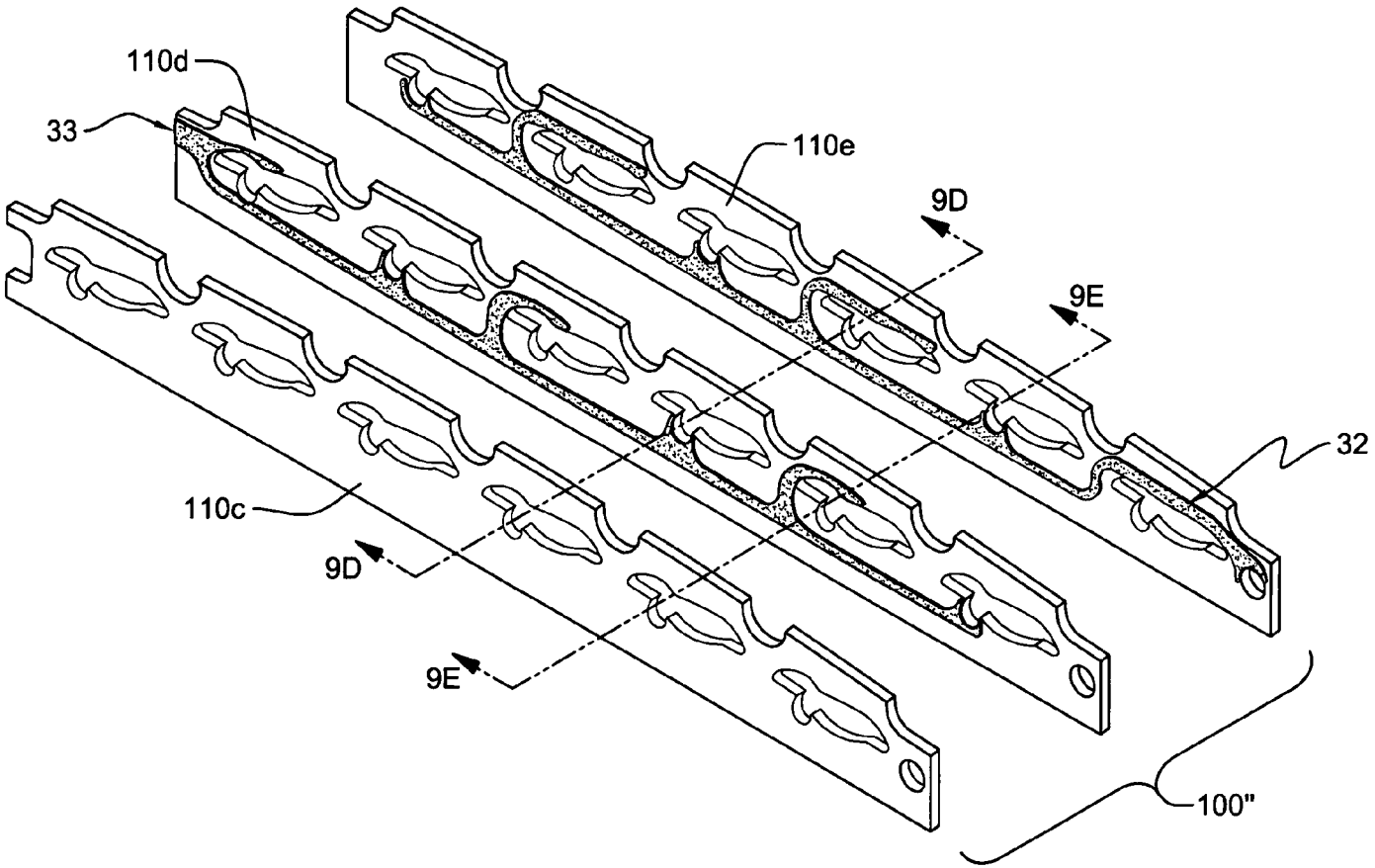
FIG. 1J shows, an orthogonal view of the unitary string saddle system of alternating phase circuit configuration of FIG. 1E, exploded to show both the alternating phase positive circuit layer 33 and negative circuit layer 32 each shown laminated on a separate body portions 110*d* and 110*e* respectively, to form unitary saddle 100".

FIG. 1J shows, an orthogonal view of the unitary string saddle system of alternating phase circuit configuration of FIG. 1E, exploded to show both the alternating phase positive circuit layer 33 and negative circuit layer 32 each shown laminated on separate body portions 110*d*, and 110*e* respectively, that laminated together with side body portion 110*c* to form unitary saddle 100".

Figure 9E:
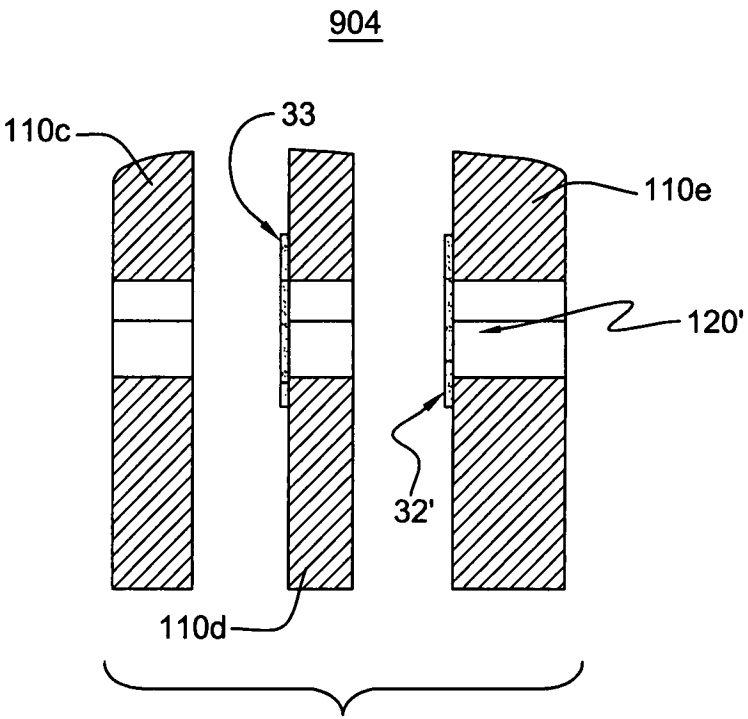
FIG. 9E depicts a side cross-sectional view 904 taken along broken line 9E-9E through an adjacent cavity of the unitary saddle embodiment depicted in FIG. 1J.
Figure 9D:
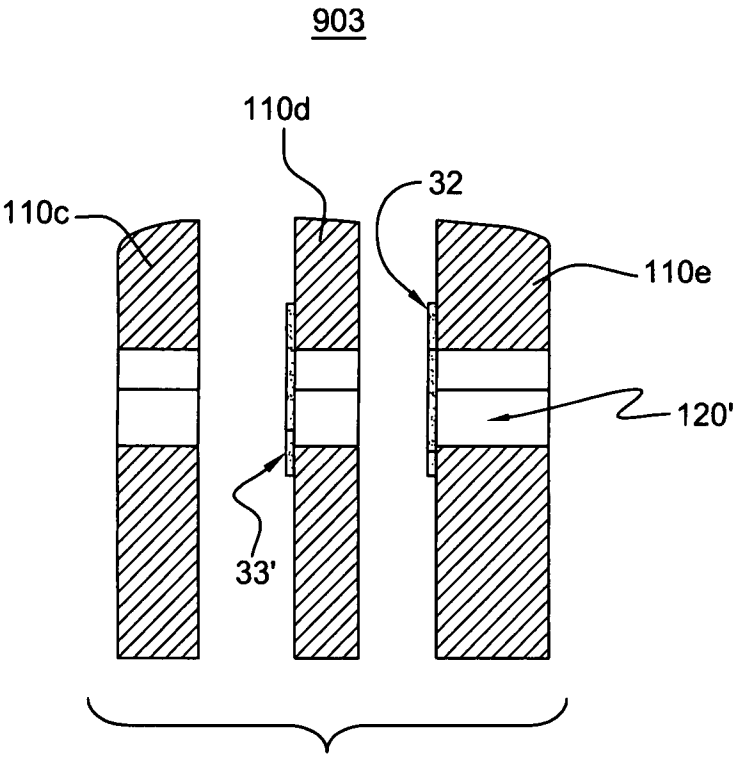
FIG. 9D depicts a side cross-sectional view 903 taken along broken line 9D-9D through a first cavity of the unitary saddle embodiment depicted in FIG. 1J.

FIG. 9D depicts a side cross-sectional view 903 taken along broken line 9D-9D through a first cavity of the unitary saddle embodiment depicted in FIG. 1J for the alternating phase unitary saddle embodiment prior to mating (e.g., laminating) the body portions 110*c*, 110*d* and 110*e* together to embed circuit path planes 32, 33. FIG. 9E depicts a side cross-sectional view 904 taken along broken line 9E-9E through an adjacent cavity of the unitary saddle embodiment depicted in FIG. 1J for the alternating phase unitary saddle embodiment prior to mating (e.g., laminating) the body portions 110*c*, 110*d* and 110*e* together to embed circuit path planes 32, 33. This cross-sectional view shows positive plane 33 and positive conductive bus portions 33' situated on opposite sides of each adjacent cavity and, negative plane 32 and negative conductive bus portions 32' situated on opposite sides of each adjacent cavity for the alternating transducer phase relation.

Unitary Plane Alternating Phase Embedded Circuit

Further to the saddle system embodiment depicted in FIG. 1I showing an internal negative circuit bus path connecting the cavity roofs in the uniphase circuit configuration wherein all the transducer connections are phased in the same direction relative to each other and each embedded conductor 32, 33 resides on a single, unitary plane, there is provided a further alternate embodiment in which an alternating phase embedded circuit in a unitary plane is provided wherein the embedded negative connections to alternating cavities are accessed via holes including conductive means extending through the saddle that provide a connective electrical path from the outside ground plane to the interior negative circuit elements to provide an alternate phase circuit configuration on a unitary plane.

Figure 1K:
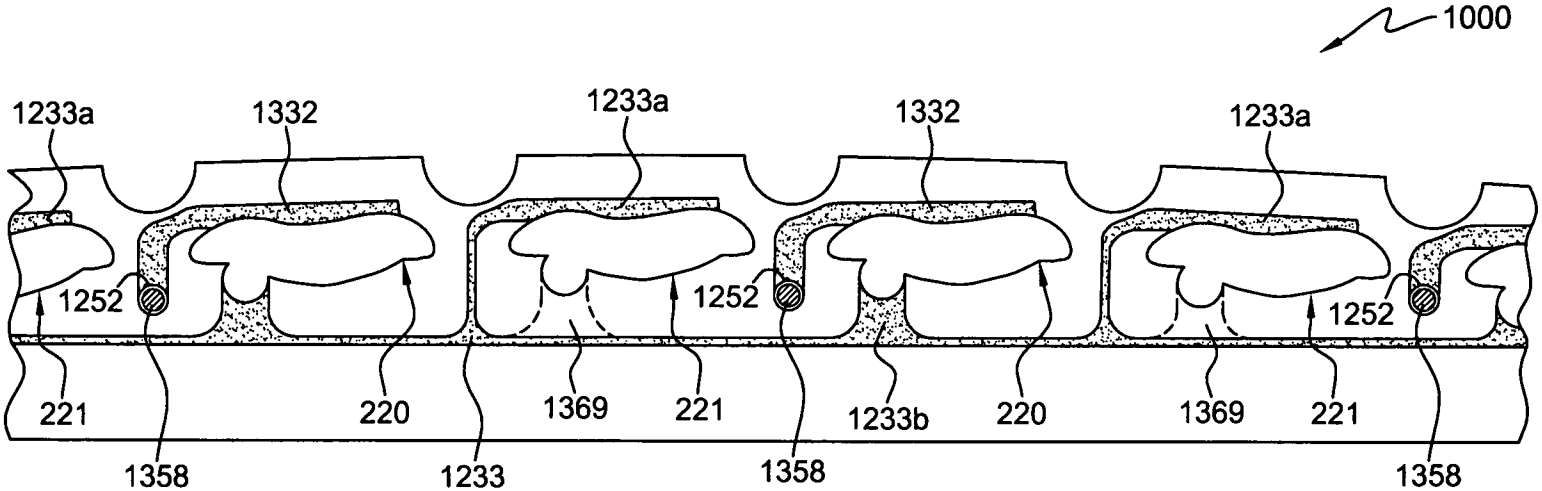
FIG. 1K depicts an exposed interior view of a portion of unitary string saddle transducer system of alternating phase circuit configuration with embedded co-planar positive and negative circuit layers formed on a single plane.
Figure 1L:
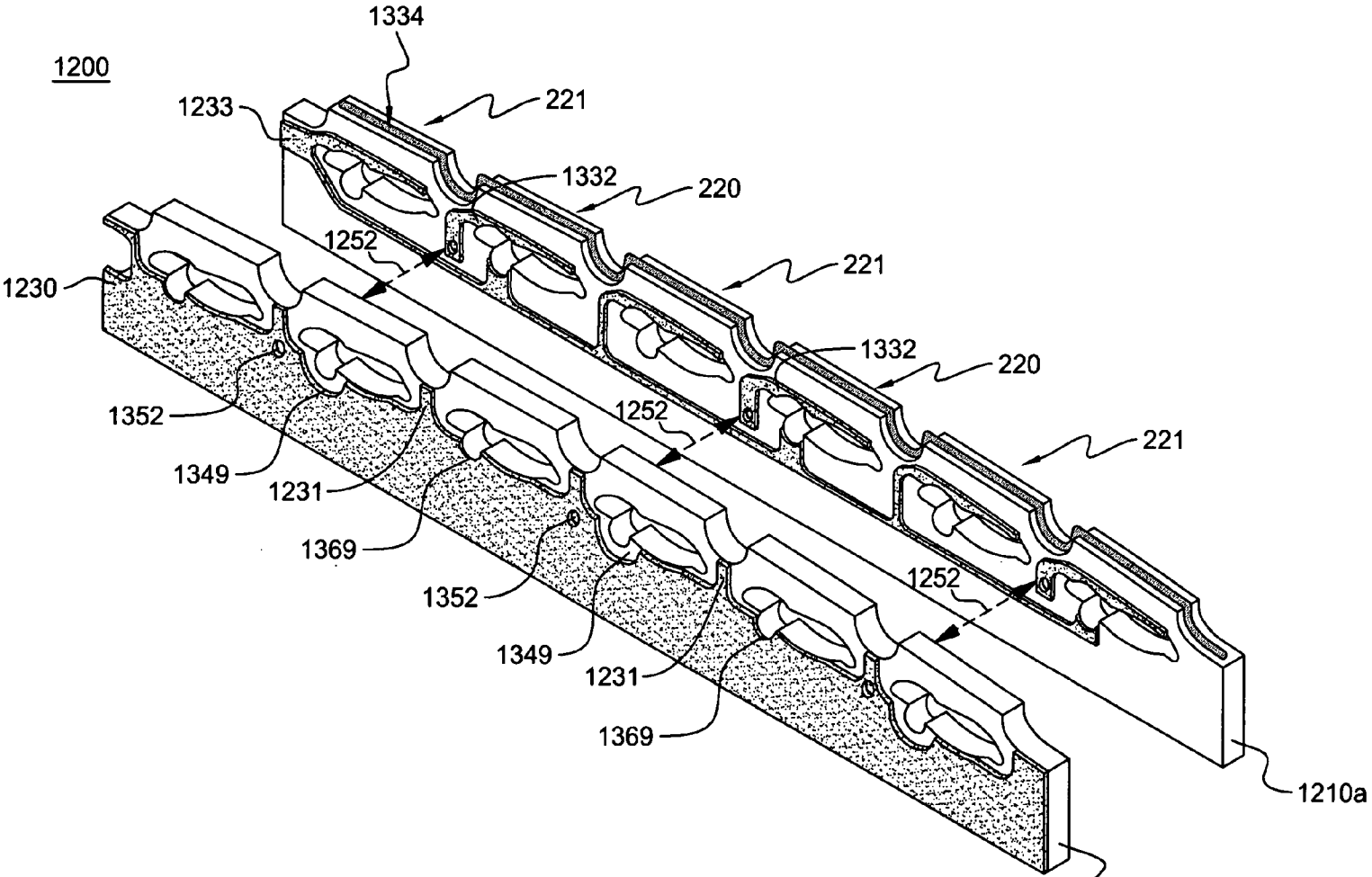
FIG. 1L shows an exploded view of an instrument saddle system 1200 having two side portions 1210*a*, 1210*b* in which is formed the embedded co-planar positive and negative circuit layers in alternating phase relation.

That is, in the exposed, interior view of a portion of unitary string saddle system of alternating phase circuit configuration of FIG. 1K and the exploded orthogonal view of FIG. 1L, there is shown saddle body 1000 including an interior having embedded alternating phase positive circuit layer 1233 (e.g., conductive laminate) such as shown (and, when configured such as conductive circuit path 233 described with respect to the embodiment of FIG. 2), including embedded conductive portions 1233*a* connecting electrical coupling points at cavity roof portions of alternating cavities 221 and, layer 1233 having conductive portions 1233*b* connecting cavity bottom portions of alternating cavities 220. In this embodiment of an interior surface (embedded portion) of saddle body 1000, further co-planar negative circuit layer (e.g., conductive laminate) connections 1332 are formed embedded within the saddle body to connect with cavity roof portions of alternating cavities 220. Bottom portions of alternating cavities 221 include outer ground plane portions 1369.

In this further alternately phased single plane embodiment, a corresponding thru hole 1352 is formed (e.g., machined) at each embedded negative circuit layer connection 1332 (conductive laminate) portion that connects with a respective cavity roof portion of each alternating cavity 220.

Further, in this embodiment, the embedded negative circuit layer connections 1332 include portions that are exposed at an interior surface of the formed hole 1252. When the hole 1352 is machined, the embedded conductive portions 1332 are exposed for electrical coupling to the outer ground plane surface 1230 such as shown in FIG. 1L).

More particularly, FIG. 1L shows an exploded view of an instrument saddle system 1200 having two side portions 1210*a*, 1210*b* in which is formed the embedded circuit paths 1233, 1322, including as conductive means, conductive laminate structures (e.g., copper laminate or like PCB structure) forming respective positive and negative circuit path layers on an internal surface of one interior surface of side body portion, e.g., 1210*a*, as shown; however, alternately, could be formed on interior surface of side body portion 1210*b*. Formed on side body 1210*b* outer surface is conductive layer (e.g., copper laminate or like PCB structure) forming an outer surface ground plane.

In one embodiment, positive embedded circuit path 1233 is formed on a single plane for contacting alternating transducer connections at alternating cavities. That is, embedded circuit path 1233 include portions 1233*a* that couple to first transducer connections at cavity roof portions of alternating cavities 221 and include portions 1233*b* that couple to second transducer connections at cavity bottom portions of alternating cavities 220 in the manner as described herein.

Negative embedded circuit path layer 1322 couple to first transducer connections at cavity roof portions of alternating cavities 220 and are further coupled to the outer ground plane surface 1230 (on outer side of body 1210*b*) via conductive coupling within respective aligned conduits or holes 1252, 1352 formed in a respective side body portion 1210*a, b*. That is, the conductive coupling of first transducer connections at cavity roof portions of alternating cavities 220 to the outer ground plane surface 1230 includes a conductive paint trace (conductive ink or epoxy substance) that electrically couples the outer ground plane 1230 to the embedded circuit layer 1322 via the formed conduit. Alternately, or in addition, a conductor device such as conductive elastomer pad 1358 (e.g., as in FIG. 1K) may be dimensioned to fit and extend within a conduit formed by the holes 1252, 1352 to provide the electrical ground coupling to the alternating cavities 220.

Further, as shown in FIG. 1K, in the manner as described herein, portions 1369 of outer surface ground plane 1230 as depicted by phantom lines, couple to second transducer connections at cavity bottom portions of alternating cavities 221 in the manner as described herein. That is, as shown in FIG. 1L, for each alternate cavity 221, the outside surface ground plane 1230 does not have a rebated edge 1349 formed at locations corresponding to the bottom of the alternating cavities 221 but rather, includes non-rebated portions 1369. Consequently, the bottom cavity pads in these alternating cavities 221 electrically couple the second transducer connection at the cavity bottom to the outside ground plane at conductive connections 1369 of outer ground plane at the alternative cavities.

Likewise, in FIG. 1L, with respect to alternate cavity 220, the outside ground plane portion 1230 aligned with those cavity bottoms includes the rebated portion 1349 (pocket)

such that bottom cavity conductive pads in these alternating cavities 220 do not electrically couple the transducer end to the ground plane, i.e., the rebated pocket isolates the lower cavity coupling pad in those cavities and further prevent short circuiting of the bottom of the transducer with the outside ground plane surface. Conversely, at each alternate cavity 221, the bottom pads electrically couple the transducer to the negative circuit path via the outside wall ground plane connections 1369 that do not have the rebated edge.

Thus, the configuration of FIG. 1K, 1L permit transducer signals of alternating phases generated at each successive cavity with the attendant advantages of providing noise cancellation effects.

Alternating Phase Embedded Circuit with Top Surface Ground Plane

Figure 1M:
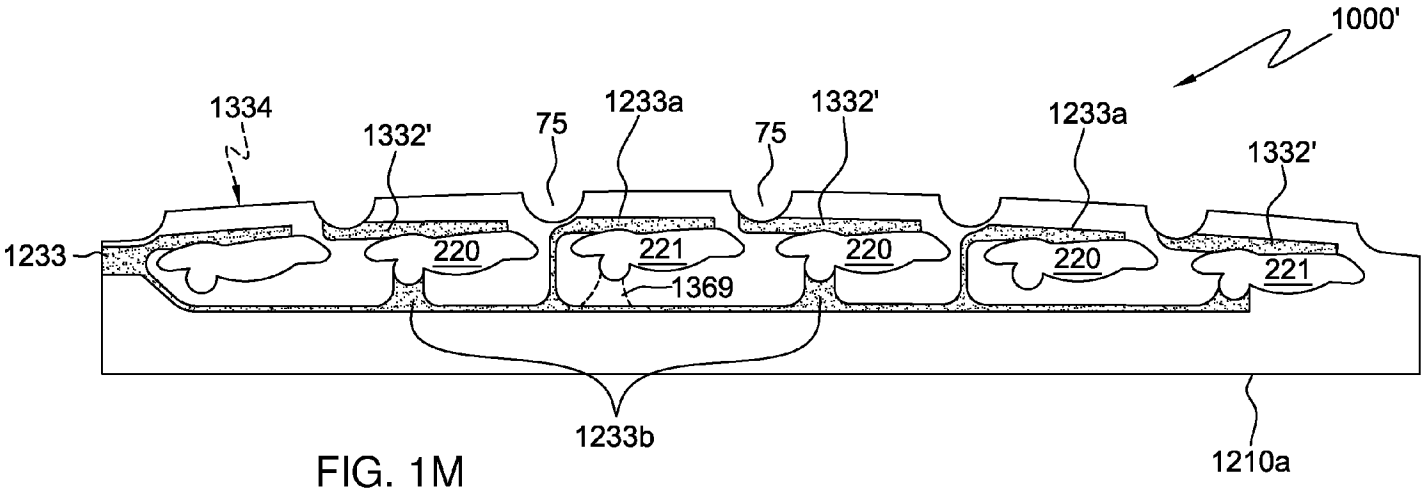
FIG. 1M shows an exposed interior plan view of a further embodiment of the transducer saddle 1000' in which internal isolated negative circuit paths 1332' at alternating cavities extend to couple with a saddle top surface conductor.

In the alternate embodiment of FIG. 1L, the top surface of the saddle body 1210*a* (or alternatively, 1210*b*, or both body side portions), above the cavities beneath the strings, includes an applied coating of conductive material 1334 (e.g., conductive paint). The coating creates a top shielding ground plane which connects to the outside ground plane(s) at the locations where the outside ground plane extends up to the top outside surface, e.g., at locations 1231 shown in FIG. 1L at the articulated radii 75 between the strings. Thus, in a further alternate embodiment, shown in the exposed interior plan view of the transducer saddle 1000' of FIG. 1M, the internal, alternate-phased negative circuit connections are connected by having the internal isolated negative circuit paths 1332' at alternating cavities 220 extend up to and be exposed at the top string support surface for coupling with the conductive paint 1334 and thus make connection to the external negative ground plane. This alternate embodiment would make the same electrical connection that the conductive element makes in through holes 1352, 1252 make shown in FIG. 1L.

Figure 1N:
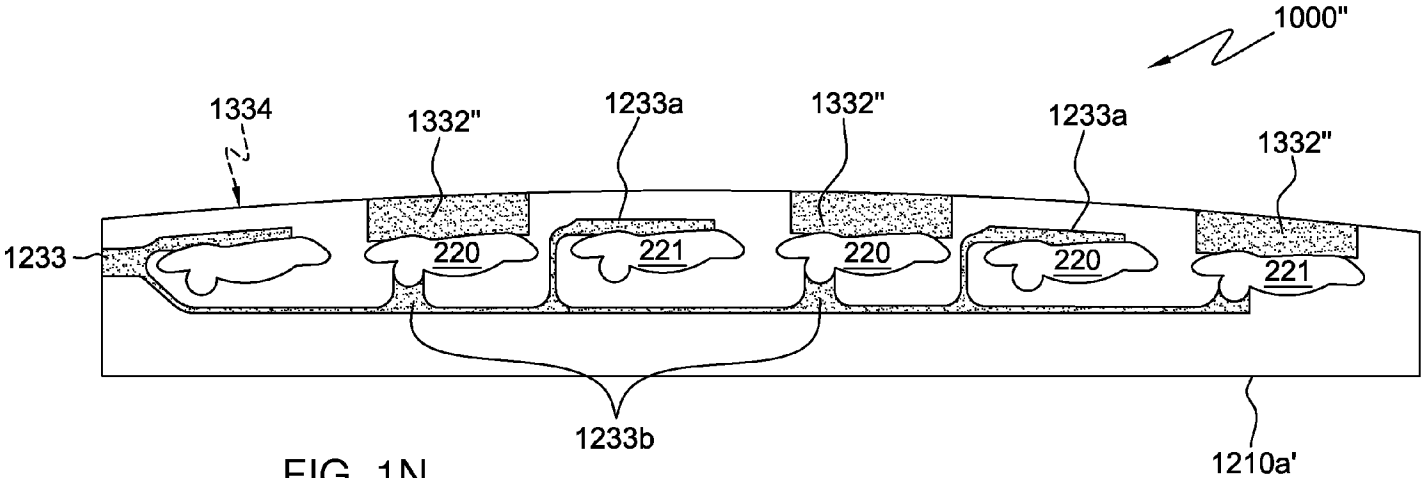
FIG. 1N shows an exposed interior plan view of a further embodiment of the transducer saddle 1000" of FIG. 1N in which internal isolated negative circuit paths 1332" at alternating cavities extend to couple with a saddle top surface conductor.
Figure 2:
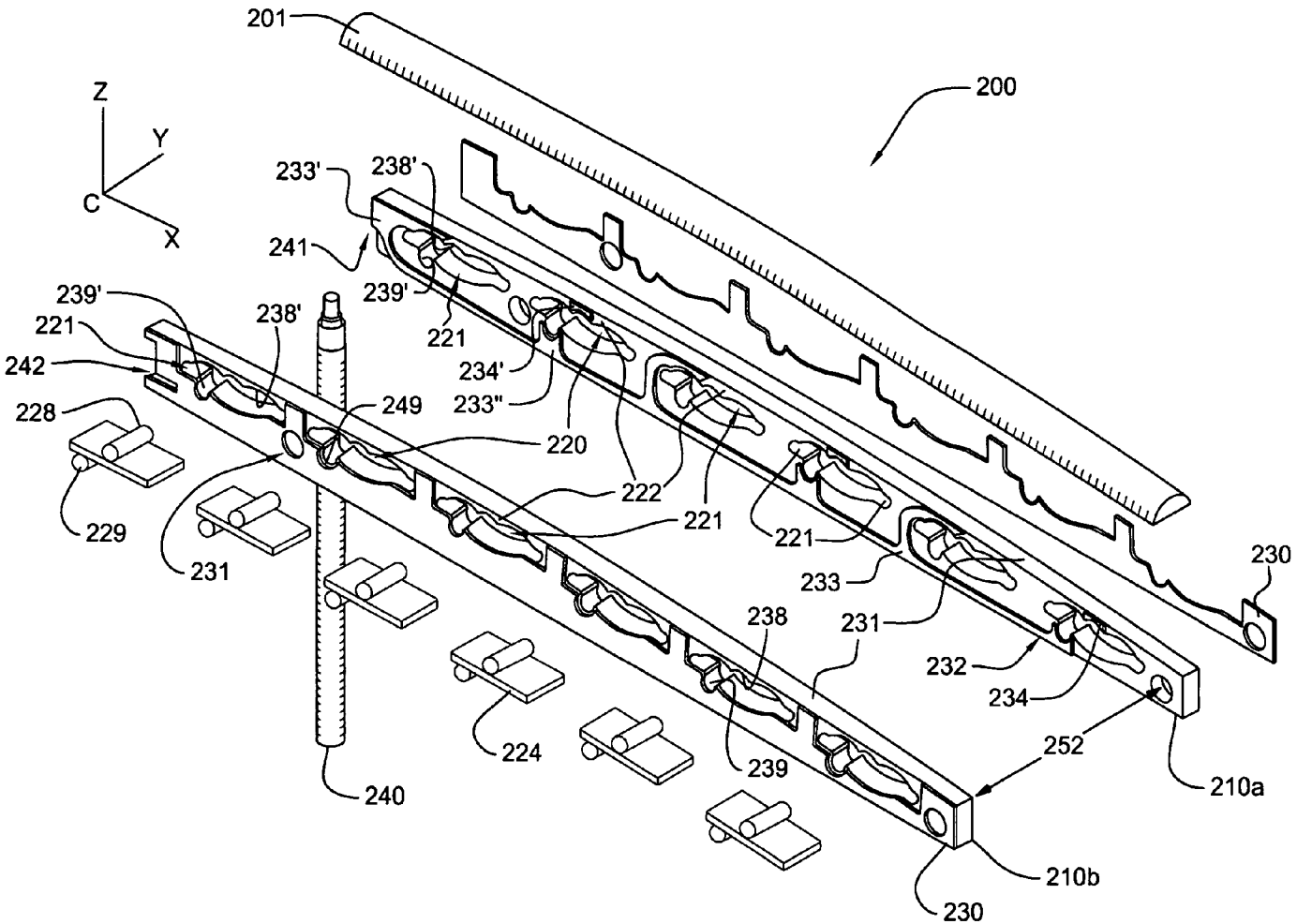

In a further alternate embodiment, shown in the exposed interior plan view FIG. 1N, the radial articulations of the saddle body structure are omitted. Thus, in this alternate embodiment of a tranducer saddle 1000" of FIG. 1N, the internal, alternate-phased negative circuit path connections 1332" extend up to and be exposed at the top string support surface beneath the strings, with the top surface having the conductive coating 1334 connecting to the outside (exterior) side ground planes and the internal negative circuit path connections.

It is further understood that the conductive coating 1334 on the top, string support surface also connects the strings to the ground potential of the circuit which further increases the shielding of the circuit.

Returning to FIG. 2, in both the uniphase and alternating transducer phase arrangements, the body portions 210*a,b* can be constructed from a lamination of copper clad printed circuit board (PCB) material or any other suitable substrate material upon which a conductive layer or skin is attached to the surfaces. The ground/negatively coupled layer is clad on both outside surfaces with copper or an equivalent conductive layer, and the positively coupled lamination layer is clad the inside surfaces of body portions 210. Copper or conductive material may further be embedded on body surface portions by molding, thermoforming, or stamping techniques, etc. The body portions are then laminated together with an adhesive, with the positive circuit paths sandwiched inside, while the ground planes on the top, outer sides and (optionally) bottom surfaces provide Electromagnetic Interference (EMI) shielding of the embedded positive circuitry. The laminated body portions may be indexed together with pins. Particularly, as shown in FIG. 2, indexing pin holes 252, 253 are provided that extend through the laminated body portion plates for precision alignment of the second conductor to coupling points in said integral cavity structures.

Figure 7:
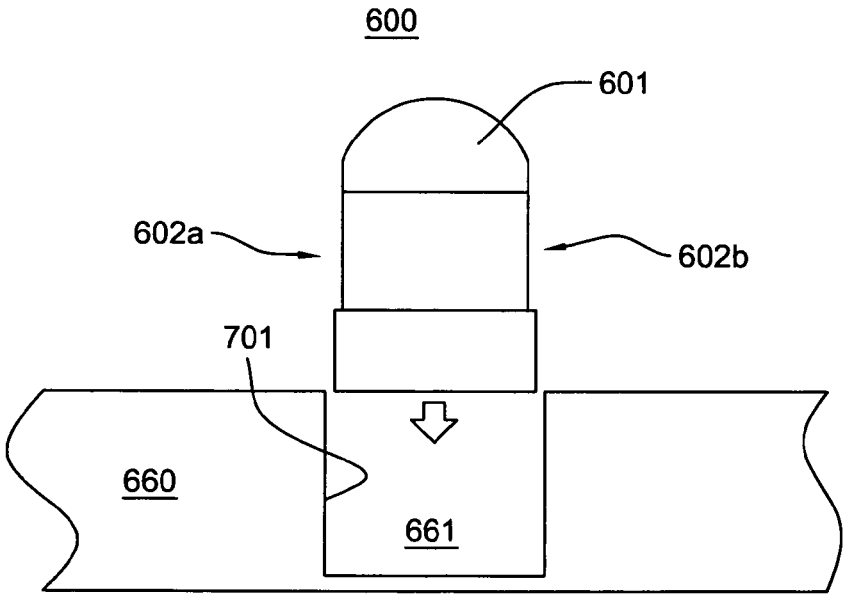
FIG. 7 depicts a side cross-section view of the saddle body, which may be of unitary structure, that is situated for mounting within a mounting slot including an opening formed at a surface of the multi-stringed musical instrument.

In one exemplary embodiment, as further shown in FIG. 2 and in greater detail in FIG. 7, the defined vertical area of sensitivity 222 at each outer body portion surface is rebated to provide clearance in a mounting slot when the saddle is mounted in an aperture on the stringed instrument. Clearance pockets in the front and back face of each cavity's vertical area of sensitivity maintain physical clearance for unimpeded vertical sensitivity. In one embodiment this rebated pocket also isolates the positive top coupling pad and its mounting area from the negative external groundplane. The mechanical clearance for the vertical area of sensitivity could also be achieved using vertical shims (not shown) instead of rebate pockets. That is, shims may be provided on the front and back faces of the saddle, in the same locations as the non-rebated areas. However, in one embodiment there is rebating around the areas of the positive top coupling pads to maintain circuit integrity and no shorting between positive top pad areas and negative ground plane.

In one embodiment, as described, bisected holes in the transducer support ledges clasp conductive elastomer pads. Conductive paint is applied to the insides of the holes to increase the conductive surface contact area. In the case of the bottom negative connections the conductive paint extends the negative outside ground planes circuit path into the inner surface of the bottom negative containment structures. In the case of said second electrical coupling points inside of said second alternate integral cavity structures, the conductive paint extends within the electrically indexed containment structure to contact the first conductor on opposing body surfaces.

The conductive elastomer pad, contacting a conductive surface coating, is clasped in the holes within each cavity and makes electrical contact with the internal (positive) and external (negative) circuit paths. The conductive pads are shown situated substantially transverse with respect to the length of the body portion, and extend slightly out of the top of the supporting structure (nest or ledge) and beyond the surface of the ledge. In other embodiment, the conductive pads are situated parallel with the length of the saddle body. The transducer rests upon the ledge where the clasped elastomer pads are exposed, thereby making the appropriately phased electrical contacts to the electrode surfaces of the transducer. In the embodiments depicted in FIGS. 5A-5C however, the angle of the cavity roof ramp relative to the horizontal transducer surface and the durometer of the elastomer of the pad determines the degree of coupling/compression needed in order to achieve the desired level of output performance. It is understood that different size and durometer pads may be implemented in different cavities of the same saddle to further balance the various string outputs.

In a further embodiment, the conductive elastomer pads of FIGS. 5A-5E could be eliminated and a conductive surface of the top angled or flattened cavity roof extended to contact the transducer directly. Likewise, a conductive contact on one of the bottom ledge support areas functions as the bottom transducer electrical circuit contact.

As further shown in FIG. 2, the body portions provide a notched slot (not shown) or like recess for accommodating connection of a shielded cable 240 that is affixed to the saddle system with adhesive and the positive and negative connections are made to their respective positive and negative circuit paths contact points via solder or conductive adhesive. The respective contact points may be incorporated into the body portion of the musical instrument in the form of an output jack for receiving a dual-polarity output connector to transmit the signal via an instrument cable. As shown in FIG. 2, there is illustrated a further cable mounting pocket 241 running from a bottom surface of the body portion to an exposed internal circuit soldering point for routing of external connector cable to an internal connecting point. Particularly, a pocket 241 is machined at one end of the body portion of the saddle that exposes embedded internal positive conductor (positive circuit path) for accommodating connection, e.g., by soldering, to a positive polarity output cable 240 connection. Additionally, there is machined a notched slot 242 in end of the body portion of the saddle for routing of aground connection from cable 240 to external ground plane on exterior outside saddle body surface. Although not shown, shielded output cable 240 can be coupled directly via the output jack to an external amplifier/high impedance pre-amplifier circuit or signal processor. Additional pre-amplifiers may be incorporated within the body of the instrument before outputting the signal from the transducers to an external amplifier/processor.

FIG. 3A shows the exploded saddle system of FIG. 2 as a partially assembled saddle system 200, according to an exemplary embodiment of the present invention. As shown, ground plates 330 extend to the top surface of body portion 210. Also, negative circuit contacts 334 extend to the top surface. Body portion top surface ground plane 231 in FIG. 2 connects all the negative contacts 334 to a ground potential. The alternating arrangement of grounding lower and upper elastomer pads is also represented.

For the above-described embodiments, the top of the saddle may be shaped as desired to accommodate the strings. For instance, classical guitars do not have a radius in the saddle, and the saddle is flat with no arc. The figures show a top saddle strip that is horizontally aligned along an axis, with the integrated cavities being in corresponding horizontal alignment. However, the top saddle structure of unitary design may be arcuate shaped, to correspond to the radius of the fretboard of the stringed instrument, with the integrated cavities being aligned according to the arcuate shape. Further, the height of the entire structure of the multi transducer saddle may be shimmed from beneath to adjust the overall height. Alternatively, a height-adjusting means may be provided in the form of adjustment screws, or equivalent. This adjustment means may be incorporated into a saddle plate for holding the saddle, the saddle plate being represented in FIG. 7.

Figure 3C:
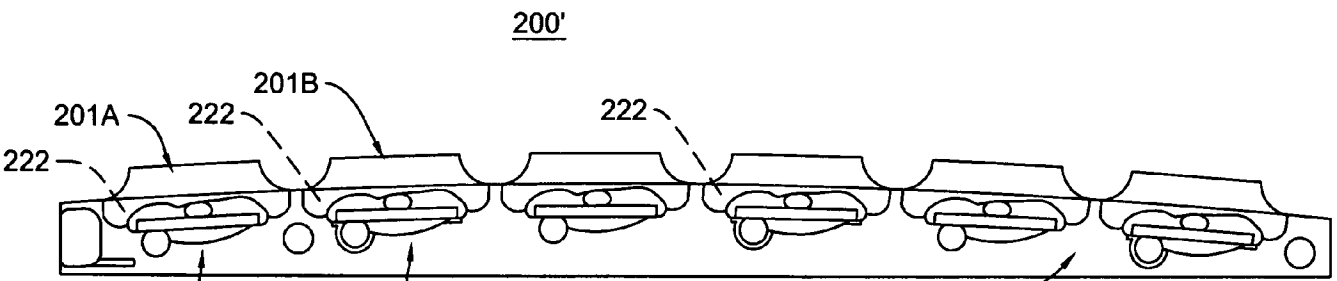
FIG. 3C shows a front elevation view of the string saddle system 200 having a segmented saddle top portion including individual top saddle portion segments.

As a further modification to the embodiment of FIG. 3A, the top saddle strip portion 201 spanning all the cavities in the first embodiment as shown in FIG. 3A, is segmented into individual saddle segments, a top saddle portion segment for an individual string. In this alternative embodiment as shown in FIG. 3C, saddle 200' includes a top saddle strip that is divided into separate individual top saddle strip/string support areas 201A, 201B, . . . etc., in correspondence with a respective string (not shown) over the body portion 210 which may be of unitary or stacked circuit board design (as shown in FIG. 3A). In the embodiment depicted in FIG. 3C, each top saddle strip segment supports an individual tensioned string and overlies the rebated vertical compliant area of sensitivity 222 as shown in FIG. 3C.

Figure 8:
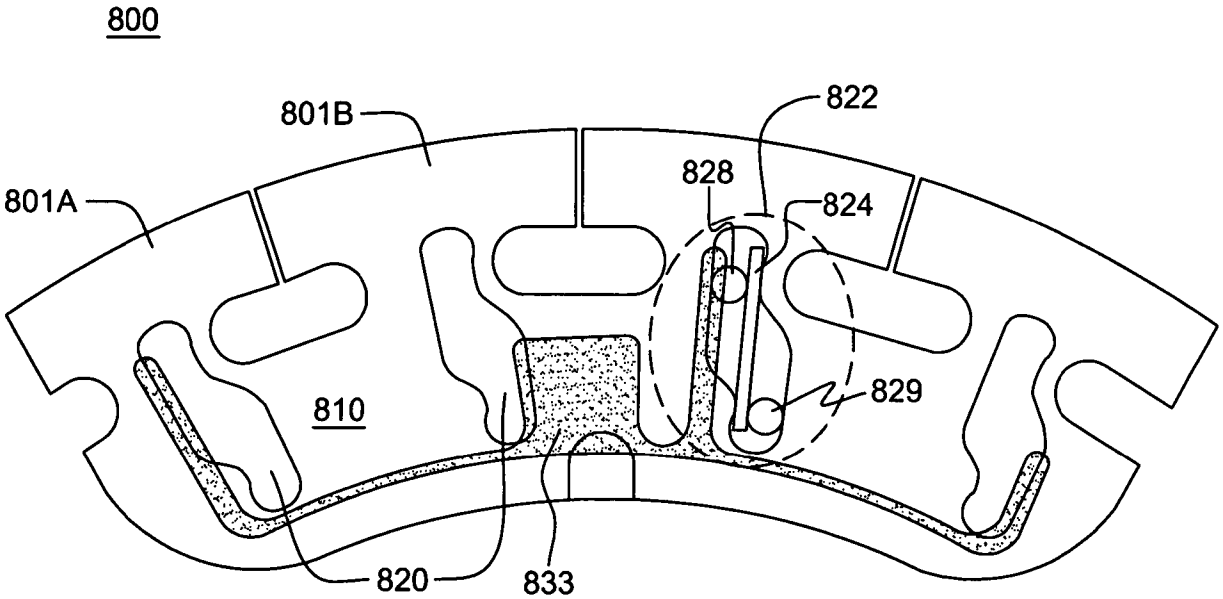
FIG. 8 shows an example unitary arcuate-shaped saddle structure 800 for a violin, bass or similar stringed musical instrument with integrated cavities 820.

FIG. 8 shows an example curved- or arcuate-shaped unitary saddle structure 800 for use in a violin, bass, or like bowed violin family instruments with integrated cavities 820 shaped as cavity structures 120, and disposed in an orientation transverse to a tangent plane (not shown) of the top saddle portion surface. The top saddle strip is divided into separate individual top saddle strip/string support areas of sensitivity 801A, 801B, . . . etc., in correspondence with a respective string (not shown) over the body portion 810 which may be a unitary, stacked (laminated) circuit board design as described herein. The physical dimensions of this slot 820 are dictated according to the size of the saddle, depending upon the type of stringed instrument in which it is installed. As further shown in FIG. 8 is an embedded circuit portion 832, i.e., a laminated conductor for a (positive or negative) circuit path for coupling to a respective transducer within the cavity.

In the saddle structure of FIG. 8, the transducer element 824 is mechanically supported by and electrically coupled at coupling points by respective conductive upper and lower coupling pads 828, 829 situated within the respective cavity. In one embodiment, the element 824 is supported in the cavity by conductive elastomer pads 828 and 829, e.g., that may be wedged or otherwise compressed against the wall surfaces at upper and lower ends as described with reference to other embodiments herein (e.g., FIGS. 5A-5E). Further detail concerning the cavity 820 as shown in broken circle depicted in FIG. 8 is now shown in more detail with respect to FIG. 8A.

Figure 8A:
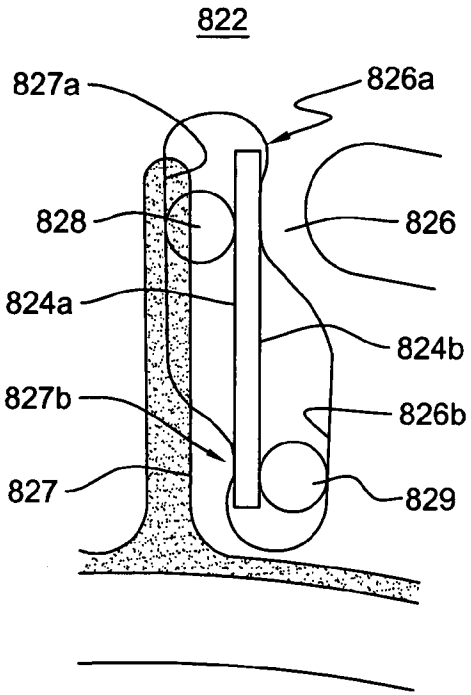
FIG. 8A shows detail of the electrical coupling and mechanical connections of a transducer element to a respective cavity in the unitary arcuate-shaped saddle structure 800 of FIG. 8.

In one embodiment depicted in FIG. 8A, each respective transverse oriented cavity 820 in the body portion 810 includes an elongated z-shaped slot defined by walls at an upper cavity portion having opposing surfaces 826*a*, 827*a* and walls at a lower cavity upper portion having opposing inner cavity surfaces 826*b*, 827*b* upon which a transducer element 824, e.g., a unimorph or bimorph, is supported. Surface 826*a* is a ledge surface defined by an inner cavity ledge structure 826 for mechanical and/or electrical mounting of one transducer end and, surface 827*b* is a ledge surface defined by an inner cavity ledge structure 827 for mechanical and/or electrical mounting of the other transducer end. More particularly, in FIG. 8A, given a flexurally responsive unimorph or bimorph-type transducer element 824, upper pad 828 of the conductive elastomer pads mechanically couples a point on one cavity sidewall 827*a* to a point on one side 824*a* of the transducer element 824 while providing compressive force for supporting element 824 against opposing cavity wall surface 826*a*. In one embodiment, the pad 828 may be nested and compressed within the cavity sidewall. The upper pad 828 thus mechanically couples an area of sensitivity 822 to the transducer element 824 for horizontally oriented string vibrations. At mechanical coupling point at sidewall 827*a*, the upper conductive pad 828 may additionally provides electric coupling at side face 824*a* of the transducer element to a positive or negative circuit path, dependent upon whether the device is configured as uniphase or alternate phasing (of the adjacent transducers) such as shown in FIG. 2. In an alternate embodiment, a non-conductive elastomer pad 828 may be used—in which case, the cavity sidewall 826*a* may provide the electrical contact point to one of the embedded circuits, e.g., by a conductive ink, paint trace, or epoxy located at the cavity sidewall surface that is electrically coupled to one embedded circuit.

It is understood that the transducers could be electrically coupled directly to the embedded contact points 826*a* at the mechanical contact points via conductive adhesive—thus eliminating the elastomer pads.

Unlike the cavity structures 120, 220 of FIGS. 1 and 5, the cavity 822 of FIG. 8A and transducer is situated transversely relative to a saddle surface for sensing horizontal bowed string vibrations. However, it may be further oriented horizontally for the sensing of vertical string vibrations with the mechanical (input) sensitivity provided at point 826*a*.

Likewise, in FIG. 8A, lower pad 829 of the conductive elastomer pads mechanically provides an anchoring point for the cantilever mounted transducer at bottom ledge portion 827. That is, while electrically coupling a point on opposing side 824*b* of the transducer element 824 to a point on one cavity sidewall 826*b*, the pad 829 provides compressive force for supporting element 824 against opposing cavity wall surface 827*b* of cavity ledge 827. In one embodiment, the pad 829 may be nested and compressed within the cavity sidewall. The upper pad thus 828 thus mechanically couples an area of sensitivity 822 to the cantilever-mounted, flexurally responsive transducer element 824 for horizontally oriented string vibrations. At the sidewall anchoring point, the lower conductive elastomer pad 829 provides additional electric coupling near opposing side face 826*b* of the transducer to a ground/negative plane or to the positive circuit path depending on the phasing of the transducer 824. In an alternate embodiment, a non-conductive elastomer pad 829 may be used—in which case, the cavity sidewall 827*b* may provide the electrical contact point to one of the embedded circuits, e.g., by a conductive ink, paint trace, or epoxy located at the cavity sidewall surface that is electrically coupled to one embedded circuit.

Alternately, in FIG. 8A, the elastomer pads do not have to function as mechanical coupling elements; the transducer may be coupled directly to the cavity wall and receive mechanical input at point 826*a* while anchored at point 827*b* similar as to the embodiment described in connection with FIG. 5F.

Figure 8B:
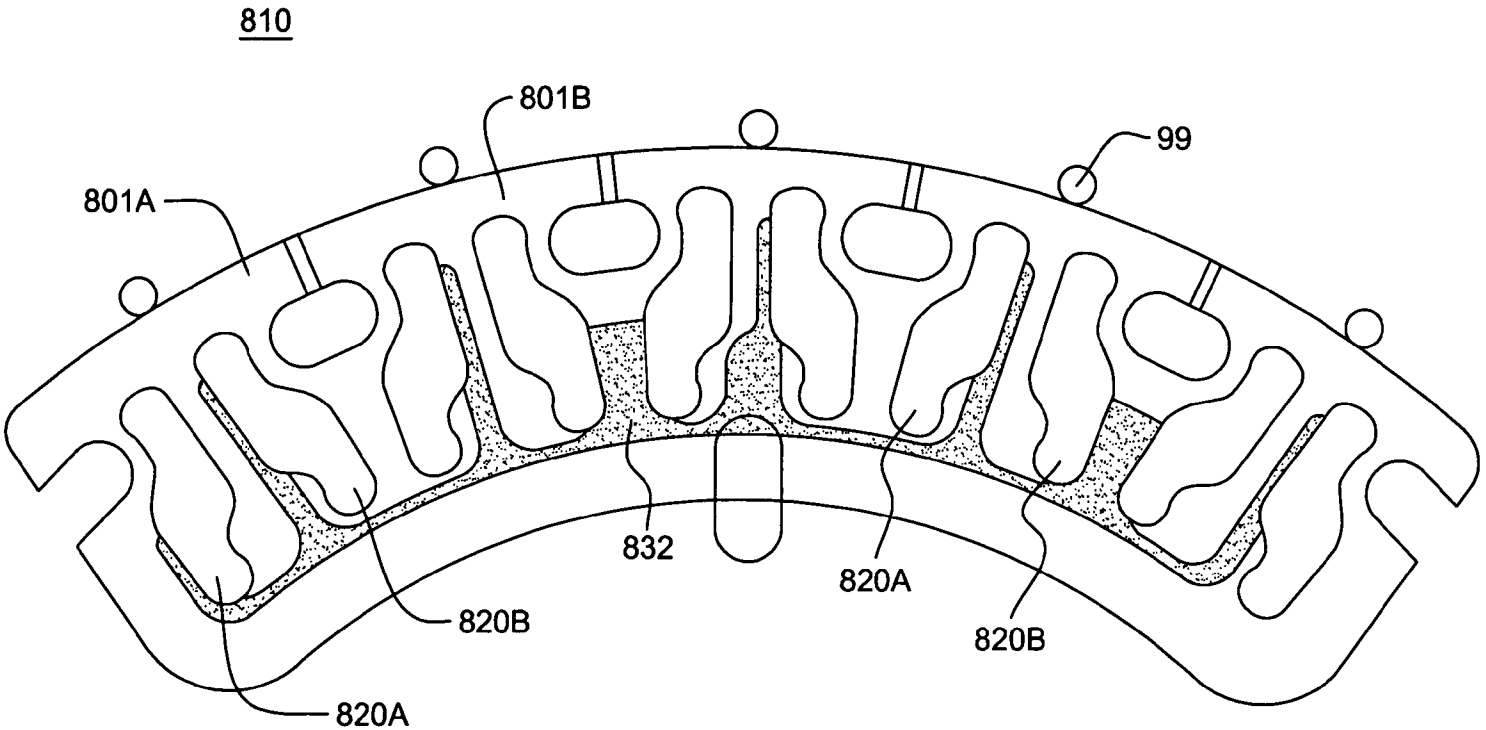
FIG. 8B shows an example unitary arcuate-shaped saddle structure in an alternate embodiment wherein each saddle strip/string support area includes two aligned and integrated cavities 820A, 820B.

FIG. 8B shows an example unitary arcuate-shaped saddle structure 800' for a violin, bass or similar stringed musical instrument in an alternate embodiment. In the embodiment of FIG. 8B, there are two integrated cavities 820A, 820B aligned for each single respective saddle strip/string support area 801A, 801B, . . . etc., in correspondence with a respective string 99 shown over the unitary, stacked circuit board body portion. In the embodiment saddle structure of FIG. 8B, each respective integrated cavity 820A, 820B of body portion 810 is the elongated flattened z-shaped slot for supporting a respective transducer element (not shown) within the respective cavity as described herein with respect to FIG. 8A. The physical dimensions of each slot comprising cavity 820A, 820B are designed in accordance with the size of the saddle, depending upon the type of stringed instrument in which it is installed. As further shown in FIG. 8B is an embedded circuit plane 832, i.e., an embedded laminated conductor, for a (positive or negative) circuit path for coupling to a respective transducer within each cavity in a uniphase or alternating phase embodiment.

Figure 8C:
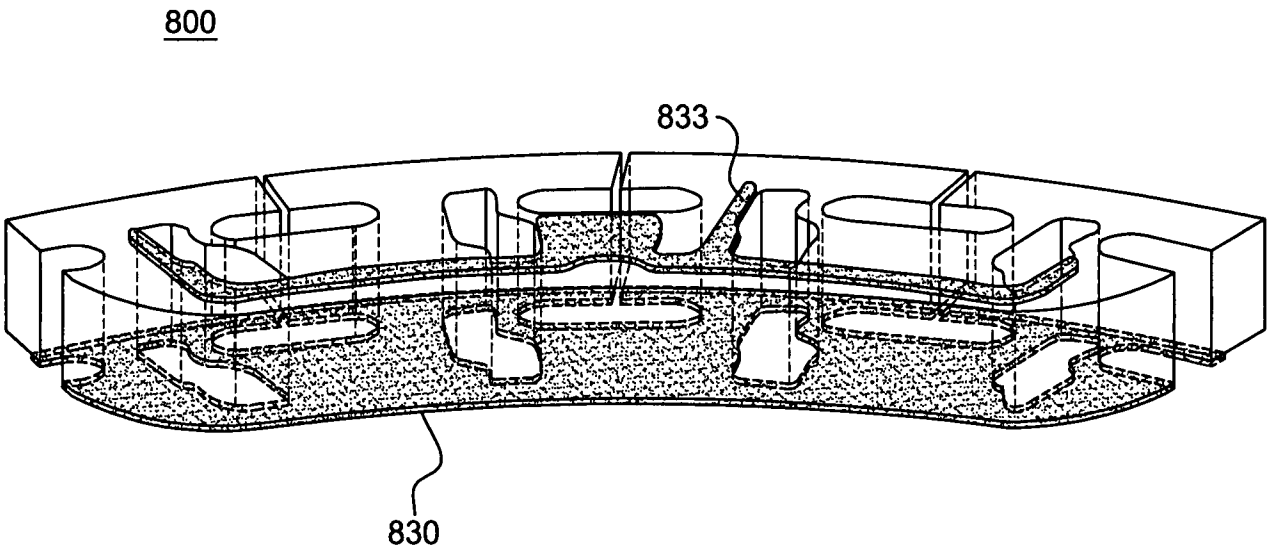
FIG. 8C depicts a saddle structure side view of showing embedded positive circuit path 833 as one or two embedded layers, and separate, negative ground plane(s) on other layers 830.

The embedded circuit paths provide electrical connections without wires and without soldered connections, to the array of transducer elements mounted within a stringed musical instrument bridge or string support structure. Thus, for example violin family stringed instrument 800, the electrical connections are made by way of a multi layer, embedded circuit integrated within a multi transducer bridge structure: the layers, as shown in the view of FIG. 8C, including a positive circuit path (positive plane) 832 as one or two embedded layers, and a separate, negative ground planes on other layers 833, for example. It is understood that a further saddle body layer(s) may be laminated on each respective surface to embed the conductive planes 832 and 833 within the saddle structure. All electrical connections to transducer elements in the violin saddle body cavities are formed in accordance with the embodiments described herein.

Further, the embedded circuit providing electrical contact points within the structure of the bridge facilitates wireless and solderless electrical connections to transducer elements mounted within the bridge structure. The string support structure(s) can be the entire bridge (FIG. 1) or separate string support structures (FIG. 1A) within a larger bridge structure. The embedded circuit routes to contact points within the bridge structure, the contact points being exposed areas of the circuit which are in alignment with desired points of contact with the mounted transducer elements.

In one embodiment, the size of the contact points may be enlarged, for example, by applying conductive paint at the areas of circuit exposure. The enlarged contact areas are located at places within the bridge or string support structure to facilitate the placement of conductive elastomer bridging pieces (coupling pads) between the contact points and the exposed electrodes of the transducer(s) thus making electrical connection between the transducer and the embedded circuit.

Second Embodiment

In an alternative embodiment, the entire string saddle and body is divided into mechanically and electrically discrete individual unitary saddle body segments, a separate and discrete segment supporting each string. Each discrete saddle/body segment containing all the described elements for transducer mounting, circuitry and electrical and mechanical coupling of a suspended transducer and supporting an individual tensioned string over each separate corresponding top and body portion segment. This embodiment, referred to as a string saddle "kit", comprises a plurality of individual string saddle segments, each saddle segment in correspondence with a respective string of an instrument to receive vibratory energy there from. The benefits of such an arrangement are many, including the ability to individually alter the total length of each string (also known as intonation), individual string height adjustment, as well as the flexibility to install multiple string saddles and wire them individually to an output or processor for flexible signal processing. Moreover, this second embodiment allows for additional flexibility as the discrete individual saddle body segments of the kit are replaceable, and the individual saddle segments could be customized by a luthier for different intonation setups as needed.

Figure 4:
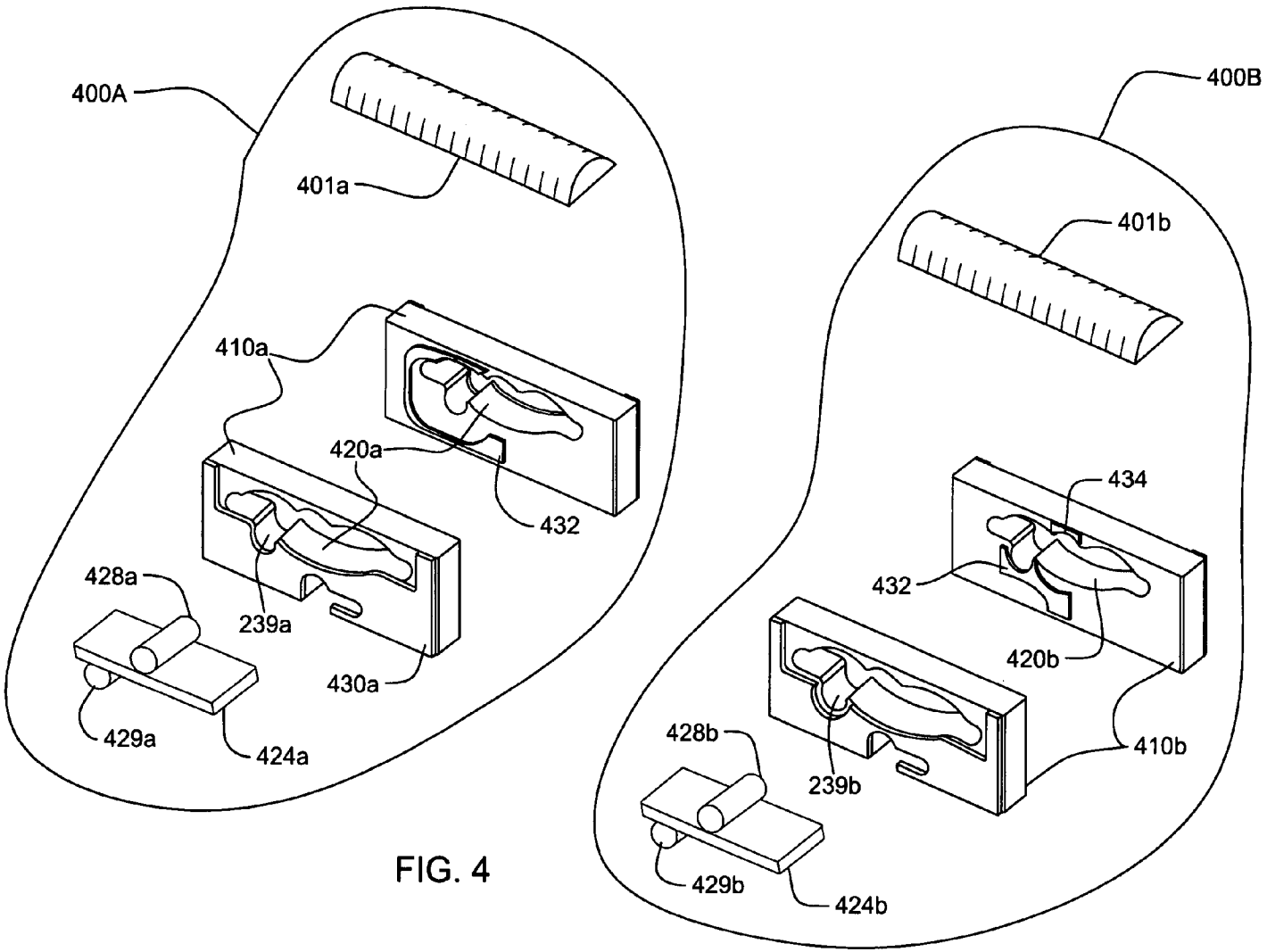
FIG. 4 shows individual transducer saddle systems with alternating phase circuits, according to an exemplary embodiment of the present invention.

FIG. 4 shows the configuration of a string saddle kit according to this embodiment of the present invention. In FIG. 4, exploded views of two individual string saddle systems are shown—although it is understood that a plurality of separate individual top saddle strip segments would be implemented in corresponding alternating manner in accordance with the number of strings of a multi-stringed instrument as described herein with respect to the unitary saddle system. In FIG. 4, saddle system 400A comprises body portions 410A that each have their outer surfaces laminated with ground plane 430A and inside surface of at least one portion laminated with positive circuit path 432 in a manner as described with respect to cavity 221 of FIG. 2. Cavity 420A houses transducer element 424A, which is mechanically and electrically coupled to the top and bottom surfaces of cavity 420A by conductive elastomer pads 428A and 429A, respectively. Aside from mechanically coupling the top surface of transducer 424A to the vertically compliant area of cavity 420A, pad 428A further electrically couples transducer 424A to positive circuit path 432. Further, bottom pad 429A electrically couples the bottom surface of transducer 424A to ground plane 430A via containment structure 239*a*, which includes an exposed conductive connection point. An individual saddle strip 401A is coupled to the top surface of body portions 410A, when sandwiched together, to support a vibrating string above saddle strip 401A and transmit vibratory energy there form to the vertically compliant area, and therefore to transducer 424A.

Similarly, saddle system 400B comprises body portions 410B that have their outer surfaces laminated with ground plane 430B. Unlike saddle system 400A, however, one or both body portions 410B have an inside surface portion provided (e.g., laminated) with a top conductive portion that connects with negative circuit path 434 via a top ground plane. Further, the inside surface of at least one body portion is laminated with positive circuit path 432 that is situated for contacting a bottom surface of transducer element within the cavity in a manner as described with respect to cavity 220 of FIG. 2. That is, the embedded circuits of the kit segments in this embodiment do make the same connections as the unitary saddle embodiment. The adjacent segments alternately phased circuits alternately connect the top of one transducer to positive and the adjacent segment will connect the top of its respective transducer to negative. As it occurs in the unitary saddle, only alternating segments have top negative embedded circuit paths to the top ground plane.

Referring still to FIG. 4, cavity 420B houses transducer element 424B, which is mechanically coupled to the top and bottom surfaces of cavity 420B by conductive elastomer pads 428B and 429B, respectively. Again, unlike saddle system segment 400A, pad 428B electrically couples top surface of transducer 424B to negative circuit path 434. Further, bottom pad 429B electrically couples the bottom surface of transducer 424B to the embedded positive circuit path 432. An individual saddle strip 401B is coupled to the top surface of body portions 410B when sandwiched together to support a vibrating string above saddle strip 401B and transmit vibratory energy there form to the vertically compliant area, and therefore to transducer 424B.

A plurality of individual saddle systems 400A and 400B may be arranged on a stringed instrument in an alternating manner. The individual transducer signal paths would thus couple electrical signals of alternating phase relationships to avoid phase cancellation effects between the adjacently disposed transducer elements as in the unitary saddle design.

The individual, single cavity saddle systems each have their own cable with a positive and negative lead. For example, for each individual saddle segment, a single shielded connector cable may provide isolated signal output from each respective string saddle segment. The shielded connector cable including a positive polarity output cable connection for soldered connection to the embedded second conductor at an internal connecting point, and, a ground output cable connection for soldered connection to an external circuit soldering point on the external ground plane of an outside body surface of the saddle segment. The solder attach positions are at the bottom of the back face of each saddle. The individual saddle cables can all be either wired together externally or each saddle output can be run individually to a separate channel in a multi channel pre amp, wherein a separate preamplifier enables individual processing of a respective string's discrete output. This would provide additional flexibility in adjusting individual volumes for each string as well as polyphonic output for applications such as MIDI interface to a polyphonic synthesizer module. The individual cables' respective contact points may be incorporated into the body portion of the musical instrument, in the form of a notched slot or like recess for receiving a plurality of dual-polarity output connector to transmit the signal via an instrument cable adapted to receive signals from the plurality of saddle systems.

Saddle Bridge Plate

FIG. 6 shows a unitary string saddle system placed within a saddle bridge plate slot, for example, according to an exemplary embodiment of the present invention. Saddle system 501 rests snugly within slot 561 in saddle plate 560. Saddle plate 560 is coupled to the top surface of the instrument, or to a more elaborate bridge arrangement that may be adjustable in terms of height and/or Y direction, to adjust intonation. The bridge may further be coupled to a tremolo or similar floating bridge arrangement such as a Bigsby™ or Floyd Rose™. Thus, saddle plate 560 provides an interface between the saddle system 501 and the musical instrument. Further, as described above, the rebated areas prevent the sensitized areas of the structure of the cavity 520 from contacting the sides of the slot 561. This prevents the sensitized areas 520 from being mechanically damped by being forced against the walls of the saddle slot 561 from the forward pressure from the tensioned strings. Additionally, the saddles can also be free standing on the top surface of an instrument and will function without being mounted in a saddle slot.

FIG. 6 more particularly depicts the unitary saddle situated in an elongated slot. The saddle is held in the slot by the tensioned strings that run across its top surface. The saddle is typically a few thousandths of an inch undersize in width than the slot. The forward pressure of the tensioned strings pulls the saddle forward against the front wall of the slot. The rebated areas on the front and back surfaces of the saddle on each of the compliant areas provides clearance between the saddle wall and the areas of sensitivity in the compliant areas. The rebated areas are machined pockets in the front and back faces of the saddle. The clearances could also be achieved by the use of shims on the front and back walls of the saddle instead of machined pockets.

FIG. 7 depicts a cross-sectional view of the saddle body 600, which may be of unitary structure, that is situated for mounting within a mounting slot 660 including opening 661 formed at a surface of the multi-stringed musical instrument, or, in a saddle mounting plate (not shown) mounted at the multi-stringed instrument surface. Note the highlighted rebate areas 602*a, b*, which depict the clearance of the vertically compliant area with the slot (instrument) wall 701.

While the invention has been particularly shown and described with respect to illustrative and preformed embodiments thereof, it will be understood by those skilled in the art that the foregoing and other changes in form and details may be made therein without departing from the spirit and scope of the invention which should be limited only by the scope of the appended claims.

Having thus described our invention, what I claim as new, and desire to secure by Letters Patent is:

1. A string saddle system for a multi-stringed instrument comprising:

a saddle body having a top surface and opposing side surfaces, said top surface spanning all tensioned strings of said multi-stringed instrument to support the tensioned strings and to receive vibratory energy therefrom, said saddle body having a plurality of integral cavities, each integral cavity in correspondence with a respective string and defining a compliant area of sensitivity beneath each string within the saddle body, each compliant area of sensitivity extending from said top surface of said saddle body above the cavity beneath said respective string to said corresponding cavity structure and extending horizontally according to a length of said integral cavity, a flexurally responsive transducer element mechanically coupled to each integral cavity at mechanical coupling points, said transducer element for converting vibratory energy from the respective string to an electric signal, said compliant area conveying vibrations of the respective string to said transducer element via a mechanical coupling point located within each respective integral cavity structure;

a first conductor layer embedded within said saddle body; and, a second conductor layer embedded within said saddle body, said first and second conductor layers configured on a unitary plane, wherein said embedded first and said embedded second conductor layer have respective portions extending to each said integral cavity structure to provide exposed electrical contact areas at a cavity surface defining electrical coupling points for electrically connecting the transducer element to said first and second embedded conductors at each respective said integral cavity structure, the electrical coupling points electrically connect the transducer element to said first and second conductors at each respective said integral cavity structure such that said transducer element of adjacent integral cavities couple electrical signals of alternating phase.

2. The string saddle system as claimed in claim 1, wherein said first embedded conductor layer includes portions connecting defined first electrical coupling points at a location within first alternating integral cavity structures, and, said first embedded conductor layer includes portions connecting defined second electrical coupling points at a a further location within second alternating integral cavity structures.

3. The string saddle system as claimed in claim 2, wherein said saddle body comprises a first and a second side body portion laminated together, one or more said first and second side body portions including an inner and outer surface and including a conductive plane formed on said outer surface.

4. The string saddle system as claimed in claim 3, wherein said second embedded conductor layer includes portions connecting defined first electrical coupling points at a top surface location of said second alternating integral cavity structures, and, a hole extending through a side body portion for intersecting both said second embedded conductor layer portions and an outer surface conductive plane; and, a conductive means provided within said hole for establishing electrical connection between the second embedded conductor layer and said outer conductive plane.

5. The string saddle system as claimed in claim 4, further comprising:

a conductive coupling means provided at respective said defined first electrical coupling of said first alternating and second alternating integral cavity structures for electrically coupling a top transducer surface of said transducer element in said first alternating and second alternating integral cavity structures to respective first and second embedded conductor layers via exposed electrical contact areas within each said first alternating and second alternating integral cavity structures.

6. The string saddle system as claimed in claim 5, wherein said mechanical coupling points in each said first and second alternating integral cavity are co-located with said first electrical and second electrical coupling points within each said first and second alternating integral cavity, wherein said conductive coupling means at first electrical coupling points further simultaneously mechanically couple said transducer element to said compliant area of sensitivity.

7. The string saddle system as claimed in claim 6, wherein said conductive coupling means comprises a flexible conductive elastomer material.

8. The string saddle system as claimed in claim 7, further comprising:

a containment structure formed and located at each said second electrical coupling points within an integral cavity having respective said exposed said electrical contact areas, said flexible conductive elastomer material being engaged within a respective containment structure formed at said second electrical coupling points.

9. The string saddle system as claimed in claim 8, further comprising:

a coating of conductive material at a surface of each said containment structure to increase the conductive surface area between each first embedded and second embedded conductor layers and a respective said flexible conductive elastomer material, wherein, for said second electrical coupling points at said second alternate integral cavity structures, said conductive paint extending within said electrically indexed containment structure to contact the outer surface conductive plane.

10. The string saddle system as claimed in claim 9, further comprising:

one or more mounting ledge formations on a bottom surface of each said first alternating and second alternating integral cavity structure for mounting of said transducer element in one of beam suspension or cantilever suspension within said integral cavity, wherein a formed mounting ledge includes a contact area for electrical coupling at a second electrical coupling point.

11. The string saddle system as claimed in claim 10, wherein each said integral cavity below each string comprises a top surface structure below its respective compliant area of sensitivity, said top surface structure including said exposed electrical contact area at said first electrical coupling point, wherein said flexible conductive elastomer material is situated between said top surface of said transducer element and said first electrical coupling point of said top surface structure.

12. The string saddle system as claimed in claim 11, further comprising:

a coating of conductive paint at a surface of said top surface structure of each integral cavity for increasing a conductive surface area between each first electrical coupling point and a respective said flexible conductive elastomer material situated therein.

13. The string saddle system as claimed in claim 12, wherein said conductive plane formed on said outer side portion surface including a rebated portion at locations corresponding to said flexible conductive elastomer material structures provided in each second alternating integral cavities to thereby isolate the transverse conductive elastomer pad material and prevent a short circuit between said first embedded conductor layer at a bottom surface location of second alternating integral cavity structures and the conductive plane formed on said outer side portion surface.

14. The string saddle system as claimed in claim 3, further comprising: a conductive material coating on said top surface of said saddle body, wherein said conductive plane formed on said outer surface of a side body portion includes a portion electrically coupled to said top surface conductive material coating.

15. The string saddle system as claimed in claim 14, wherein said first embedded conductor layer portions connecting said defined first electrical coupling points at location within first alternating integral cavity structures extend upwards to the top string support surface for electrical coupling with said top surface conductive material coating.

16. A string saddle system for a multi-stringed instrument comprising:

a saddle body having a top surface and opposing side surfaces, said top surface spanning all tensioned strings of said multi-stringed instrument to support the tensioned strings and to receive vibratory energy therefrom, said saddle body having a plurality of integral cavities, each integral cavity in correspondence with a respective string and defining a compliant area of sensitivity beneath each string within the saddle body, each compliant area of sensitivity extending from said top surface of said saddle body above the cavity beneath said respective string to said corresponding cavity structure and extending horizontally according to a length of said integral cavity, a flexurally responsive transducer element mechanically coupled to each integral cavity at mechanical coupling points, said transducer element for converting vibratory energy from the respective string to an electric signal, said compliant area conveying vibrations of the respective string to said transducer element via a mechanical coupling point located within each respective integral cavity structure;

a first conductor layer embedded within said saddle body; and, a second conductor layer embedded within said saddle body, said first and second conductor layers configured on a unitary plane, wherein said embedded first and said embedded second conductor layer have respective portions extending to each said integral cavity structure to provide exposed electrical contact areas at a cavity surface defining electrical coupling points for electrically connecting the transducer element to said first and second embedded conductors at each respective said integral cavity structure, the electrical coupling points electrically connect the transducer element to said first and second conductors at each respective said integral cavity structure such that said transducer element of adjacent integral cavities couple electrical signals of like phase.

17. The string saddle system as claimed in claim 16, wherein said first embedded conductor layer includes portions connecting defined first electrical coupling points at a location within each integral cavity structure, and, said first embedded conductor layer includes portions connecting defined second electrical coupling points at a a further location within each integral cavity structure.

18. The string saddle system as claimed in claim 17, wherein said saddle body comprises a first and a second side body portion laminated together, one or more said first and second side body portions including an inner and outer surface and including a conductive plane formed on said outer surface.

19. The string saddle system as claimed in claim 18, further comprising: a conductive material coating on said top surface of said saddle body, wherein said conductive plane formed on said outer surface of a side body portion includes a portion electrically coupled to said top surface conductive material coating.

20. The string saddle system as claimed in claim 19, wherein said first embedded conductor layer portions connecting said defined first electrical coupling points at location within each integral cavity structures extend upwards to the top string support surface for electrical coupling with said top surface conductive material coating.

* * * * *